US006767294B2

(12) United States Patent
Nesbitt

(10) Patent No.: US 6,767,294 B2
(45) Date of Patent: Jul. 27, 2004

(54) GOLF BALL

(75) Inventor: R. Dennis Nesbitt, Westfield, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/236,808

(22) Filed: Sep. 6, 2002

(65) Prior Publication Data

US 2004/0048689 A1 Mar. 11, 2004

(51) Int. Cl.[7] ..... A63B 37/06; A63B 37/08; A63B 37/00

(52) U.S. Cl. ..... 473/369; 473/367; 473/351

(58) Field of Search ..... 473/351–377

(56) References Cited

U.S. PATENT DOCUMENTS 4,144,223 A 3/1979 Kent
4,714,253 A 12/1987 Nakahara et al.
4,836,552 A 6/1989 Puckett et al.
5,019,319 A 5/1991 Nakamura et al.
5,688,192 A * 11/1997 Aoyama ..... 473/374
5,725,443 A 3/1998 Sugimoto et al.
5,823,889 A * 10/1998 Aoyama ..... 473/374
5,873,796 A 2/1999 Cavallaro et al.
5,989,136 A 11/1999 Renard et al.
6,120,390 A 9/2000 Dalton
6,193,618 B1 * 2/2001 Sullivan et al. ..... 473/373
6,207,784 B1 3/2001 Rajagopalan
6,217,462 B1 4/2001 Maruko et al.
6,284,840 B1 9/2001 Rajagopalan et al.
6,319,152 B1 11/2001 Takesue et al.
6,386,992 B1 * 5/2002 Harris et al. ..... 473/371

* cited by examiner

*Primary Examiner*—Mark S. Graham
*Assistant Examiner*—Alvin A. Hunter, Jr.

(57) ABSTRACT

The present invention is directed to a solid, non-wound, golf ball comprising two or more core components, and a cover component. The core components comprise i) a pressurized foamed inner, spherical center component comprising a first matrix material selected from the group consisting of thermoset material, a thermoplastic material, or combinations thereof, a blowing agent and a cross-linking agent and, ii) an outer core layer disposed about the spherical center component, formed from a second matrix material selected from the group consisting of a thermoset material, a thermoplastic material, or combinations thereof. The golf ball may further comprise an additional outer core layer(s) that surround the outer core layer. The cover may be single or multi-layered.

21 Claims, 2 Drawing Sheets

GOLF BALL

FIELD OF THE INVENTION

The present invention relates to golf balls and specifically to the construction of solid, non-wound, golf balls for regulation play. More particularly, the invention is directed to improved golf balls comprising multi-component core assemblies which have a pressurized foamed center component. The pressurized foam center is encapsulated by one or more core layers which are then surrounded by a cover. The golf balls of this invention are of the same size and weight as conventional balls and have comparable or better performance characteristics.

BACKGROUND OF THE INVENTION

Golf balls traditionally have been categorized into three different groups. These are one piece balls, multi-piece solid balls comprising two or more solid pieces and wound (three piece) balls.

The one piece ball typically is formed from a solid mass of moldable material which has been cured to develop the necessary degree of hardness. In many instances, the one piece solid ball does not possess any significant difference in composition between the interior and exterior of the ball. One piece balls are described, for example, in U.S. Pat. Nos. 3,313,545; 3,373,123; and, 3,384,612.

A wound ball is frequently referred to as a "three piece ball" since it is made with a vulcanized rubber thread wound under tension around a solid or semi-solid center to form a wound core and thereafter enclosed in a single or multi-layer covering of tough protective material. For many years the wound ball was desired by many skilled, low handicap golfers, due to reported enhanced playability characteristics.

More particularly, the three piece wound ball typically has a balata or balata like cover which is relatively soft and flexible. Upon impact, the balata cover compresses against the surface of the club producing high spin. Consequently, the soft and flexible balata covers, along with the wound cores, provide an experienced golfer with the ability to apply a spin to control the ball in flight. This allows a skilled golfer to produce a draw or a fade or a backspin which causes the ball to "bite" or stop abruptly on contact with the green. Moreover, the balata cover produces a soft "feel" to the low handicap player. Such playability properties of workability, feel, etc. are particularly important in short iron play with low swing speeds and are exploited significantly by highly skilled players.

However, a three piece wound ball also has several disadvantages. For example, a wound ball is relatively difficult to manufacture due to the number of production steps required and the careful control which must be exercised in each stage of manufacture to achieve suitable roundness, velocity, rebound, "click", "feel", and the like.

Moreover, wound balls can also be knocked "out of round". One or more severe hits can damage the windings and knock the center "off center". Such a ball is then unbalanced, making putting, etc. more difficult.

Additionally, a soft wound (three piece) ball is not well suited for use by the less skilled and/or high handicap golfer who cannot intentionally control the spin of the ball. For example, the unintentional application of side spin by a less skilled golfer produces hooking or slicing. The side spin reduces the golfer's control over the ball as well as reducing travel distance.

Similarly, despite all the benefits of balata, balata covered balls are easily cut and/or damaged if mishit. Consequently, golf balls produced with balata or balata containing cover compositions can exhibit relatively short life spans. As a result of this negative property, balata and its synthetic substitute, trans-polyisoprene, and resin blends, have been essentially replaced as the cover materials of choice by golf ball manufacturers by materials comprising ionomeric resins and other elastomers such as polyurethanes.

Conventional multi-piece solid golf balls, on the other hand, include a solid resilient core having single or multiple cover layers employing different types of material molded on the core. The one piece golf ball and the solid core for a multi-piece solid (nonwound) ball frequently are formed from a combination of materials such as polybutadiene and other rubbers cross linked with zinc diacrylate or zinc dimethacrylate, and containing fillers and curing agents which are molded under high pressure and temperature to provide a ball of suitable hardness and resilience. For multi-piece nonwound golf balls, the cover typically contains a substantial quantity of ionomeric resins that impart toughness and cut resistance to the covers.

Ionomeric resins are generally ionic copolymers of an olefin, such as ethylene, and a metal salt of a unsaturated carboxylic acid, such as acrylic acid, methacrylic acid or maleic acid. Metal ions, such as sodium or zinc, are used to neutralize some portion of the acidic group in the copolymer, resulting in a thermoplastic elastomer exhibiting enhanced properties, such as durability, for golf ball cover construction. However, some of the advantages gained in increased durability have been offset to some degree by decreases in playability. This is because, although the ionomeric resins are very durable, they also tend to be quite hard when utilized for golf ball cover construction and thus lack the degree of softness required to impart the spin necessary to control the ball in flight. Since most ionomeric resins are harder than balata, the ionomeric resin covers do not compress as much against the face of the club upon impact, thereby producing less spin. In addition, the harder and more durable ionomeric resins lack the "feel" characteristic associated with the softer balata related covers.

As a result, while there are currently more than fifty (50) commercial grades of ionomers available, both from DuPont and Exxon, with a wide range of properties which vary according to the type and amount of metal ions, molecular weight, composition of the base resin (i.e. relative content of ethylene and methacrylic and/or acrylic acid groups) and additive ingredients, such as reinforcement agents, etc., a great deal of research continues in order to develop golf ball cover compositions exhibiting not only the improved impact resistance and carrying distance properties produced by the "hard" ionomeric resins, but also the playability (i.e. "spin", "feel", etc.) characteristics previously associated with the "soft" balata covers, properties which are still desired by the more skilled golfer.

Moreover, a number of multi-piece solid balls have also been produced to address the various needs of the golfing population. The different types of material used to formulate the core(s), cover(s), etc. of these balls dramatically alter the balls' overall characteristics.

In this regard, various structures have been suggested using multi-layer cores and single layer covers wherein the core layers have different physical characteristics. For example, U.S. Pat. Nos. 4,714,253; 4,863,167 and 5,184,828 relate to three piece solid golf balls having improved rebound characteristics in order to increase flight distance.

The '253 patent is directed towards differences in the hardness of the layers. The '167 patent relates to a golf ball having a center portion and an outer layer having a high specific gravity. Preferably, the outer layer is harder than the center portion. The '828 patent suggests that the maximum hardness must be located at the interface between the core and the mantle, and the hardness must then decrease both inwardly and outwardly.

Similarly, a number of patents for multi-piece solid balls suggest improving the spin and feel by manipulating the core construction. For example, U.S. Pat. No. 4,625,964 relates to a solid golf ball having a core diameter not more than 32 mm, and an outer layer having a specific gravity lower than that of the core. In U.S. Pat. No. 4,650,193, it is suggested that a curable core elastomer be treated with a cure altering agent to soften an outer layer of the core. U.S. Pat. No. 5,002,281 is directed towards a three piece solid golf ball which has an inner core having a specific gravity greater than 1.0, but less than or equal to that of the outer shell which must be less than 1.3.

U.S. Pat. Nos. 4,848,707 and 5,072,944 disclose three-piece solid golf balls having center and outer layers of different hardness. Other examples of such dual layer cores can be found in, but are not limited to, the followings patents: U.S. Pat. Nos. 4,781,383; 4,858,924; 5,002,281; 5,048,838; 5,104,126; 5,273,286; 5,482,285 and 5,490,674. It is believed that all of these patents are directed to balls with single cover layers.

Multi-layer covers containing one or more ionomeric resins have also been formulated in an attempt to produce a golf ball having the overall distance, playability and durability characteristics desired. This was addressed in U.S. Pat. No. 4,431,193, where a multi-layered golf ball cover is described as having been produced by initially molding a first cover layer on a spherical core and then adding a second cover layer. The first or inner layer is comprised of a hard, high flexural modulus resinous material to provide a gain in coefficient of restitution while the outer layer is a comparatively soft, low flexural modulus resinous material to provide spin and control. The increase in the coefficient of restitution provides a ball which serves to attain or approach the maximum initial velocity limit of 255 feet per second, as provided by the United States Golf Association (U.S.G.A.) rules. The relatively soft, low flexural modulus outer layer provides for an advantageous "feel" and playing characteristics of a balata covered golf ball.

In various attempts to produce a durable, high spin ionomeric golf ball, the golfing industry has also blended the hard ionomer resins with a number of softer ionomer resins. U.S. Pat. Nos. 4,884,814 and 5,120,791 are directed to cover compositions containing blends of hard and soft ionomeric resins. The hard copolymers typically are made from an olefin and an unsaturated carboxylic acid. The soft copolymers are generally made from an olefin, an unsaturated carboxylic acid and an acrylate ester. It has been found that golf ball covers formed from hard-soft ionomer blends tend to become scuffed more readily than covers made of hard ionomer alone.

A dual core, dual cover ball is described in U.S. Pat. No. 4,919,434. However, the patent emphasizes the hardness characteristics of all layers, particularly the requirement for a soft inner cover layer and a hard outer cover layer. With respect to the core, it requires that the layers should not differ in hardness by more than 10 percent and should be elastomeric materials having a specific deformation range under a constant load.

U.S. Pat. No. 5,104,126 attempts to concentrate the weight of the golf ball in the center core region by utilizing a metal ball as the core component. However, that patent teaches the use of a solid metal ball as the core component which provides substantially different properties than a polymeric core.

Additionally, according to the U.S.G.A., the initial velocity of the ball must not exceed 250 ft/sec. with a 2% maximum tolerance (i.e., 255 ft/sec.) when struck at a set club head speed on a U.S.G.A. machine. Furthermore, the overall distance of the ball must not exceed 280 yards with a 6% tolerance (296.8 yards) when hit with a U.S.G.A. specified driver at 160 ft/sec. (clubhead speed) at a 10 degree launch angle as tested by the U.S.G.A. Lastly, the ball must pass the U.S.G.A. administered symmetry test, i.e., fly consistently (in distance, trajectory and time of flight) regardless of how the ball is placed on the tee.

While the U.S.G.A. regulates five (5) specifications for the purposes of maintaining golf ball consistency, alternative characteristics (i.e., spin, feel, durability, distance, sound, visibility, etc.) of the ball are constantly being improved upon by golf ball manufacturers. This is accomplished by altering the type of materials utilized and/or improving construction of the balls. For example, the proper choice of the materials for the cover(s) and core(s) are important in achieving certain distance, durability and playability properties. Other important factors controlling golf ball performance include, but are not limited to, cover thickness and hardness, core stiffness (typically measured as compression), ball size and surface configuration.

Accordingly, a wide variety of golf balls have been designed and are available to suit an individual player's game. In essence, different types of balls have been specifically designed or "tailor made" for high handicap versus low handicap golfers, men versus women, seniors versus juniors, etc. Moreover, improved golf balls are continually being produced by golf ball manufacturers with technological advancements in materials and manufacturing processes.

In view in part of the above information, a number of one-piece, two-piece (a solid resilient center or core with a molded cover), three-piece wound (a liquid or solid center, elastomeric winding about the center, and a molded cover), and multi-layer solid or wound golf balls have been produced to address the various needs of golfers exhibiting different skill levels. The different types of materials utilized to formulate the core(s), cover(s), etc. of these balls dramatically alter the balls' overall characteristics.

It would be useful to develop a golf ball exhibiting an increased resilience and feel without substantially affecting the ball's remaining characteristics. Additionally, it would also be useful to develop a golf ball with a light-weight center having the same overall weight and size as conventional golf balls.

These and other objects and features of the invention will be apparent from the following summary and description of the invention, the drawings and from the claims.

SUMMARY OF THE INVENTION

Accordingly, it is a feature of the present invention to provide a multi-piece, nonwound, solid golf ball. The core is of a multi-layer construction. It comprises a pressurized center or inner core layer which is encapsulated by an outer core layer of different material and construction. The characteristics of the core are such that the feel, compression and/or moment of inertia of the ball may be adjusted.

An additional feature of the invention is to provide a ball having a multi-layer polymeric core having a pressurized foamed center or nucleus enclosed by an outer core layer and a multi-layer cover. The ball has enhanced feel and compression properties.

Another feature of the present invention is the provision for a golf ball having a pressurized foamed inner core. The inner core component is constructed in such a manner as to incorporate many of the desirable features associated with various categories of balls traditionally employed.

A further feature of the present invention is the provision for a golf ball core structure with a foamed inner or center polymeric core and an outer polymeric core layer, with the inner core having a specific gravity that differs from that of the outer core layer.

Yet another feature is the provision for a multi-layer core having a pressurized center that is combined with a multi-layer cover wherein the outer cover layer has a lower hardness value than the inner cover layer.

A still further feature of the invention is the provision for a golf ball having a foamed center or nucleus, a high specific gravity core layer and a soft outer cover layer with good scuff resistance and cut resistance coupled with relatively high spin rates at low club head speeds.

The present invention provides in an additional aspect, a solid, nonwound golf ball. The ball comprises a pressurized, multi-core assembly that is concentrically positioned within the center of the golf ball, and a multi-layer cover assembly disposed about the multi-core assembly.

In yet another aspect, the present invention provides a golf ball comprising a pressurized foamed center core component which is concentrically disposed about a reference point located at the geometric center of the golf ball. The golf ball further comprises an outer core layer which generally surrounds and is disposed about the center core component. The golf ball further comprises a first inner cover layer disposed and positioned around the outer core layer, and a second outermost dimpled cover layer that is disposed about the first inner cover layer. Preferably, an ionomeric material is used in at least one of the cover layers.

In yet another aspect, the present invention provides a golf ball comprising a center core component that is pressurized. Preferably, the center core component is foamed and contains a plurality of interior voids or cells, which contain an effective amount of a gas such as nitrogen that is at an elevated pressure. In certain embodiments, the pressurized center core has relatively high or low densities.

In an additional aspect, the subject matter of the present invention provides a golf ball comprising a dual polymeric core and a cover. The dual core has an inner, low density, spherical center core and at least one outer core layer. A lower or higher density outer core layer is disposed about the low density spherical center or inner core layer. A cover is then molded about the dual core.

Moreover, one or more outer core layers can be disposed about the center, followed by one or more cover layers. The outer core and/or cover layers can be made lighter and/or heavier in order to produce an overall golf ball which conforms with the weight and size requirements of the U.S.G.A. This combination of weight and size displacement decreases or increases the moment of inertia and/or allows the radius of gyration of the ball to move closer to or further from the center.

The moment of inertia (i.e., "MOI") of a golf ball (also known as "rotational inertia") is the sum of the products formed by multiplying the mass (or sometimes the area) of each element of a figure by the square of its distance from a specified line such as the center of a golf ball. This property is directly related to the "radius of gyration" of a golf ball which is the square root of the ratio of the moment of inertia of a golf ball about a given axis to its mass. It has been found that the lower the moment of inertia (or the closer the radius of gyration is to the center of the ball) the higher the spin rate is of the ball with all other properties being held equal.

In all of the above aspects, the present invention is directed, in part, to providing a pressurized center core component. This increases the resilience and feel characteristics of the ball.

The present invention is also directed to decreasing or increasing the moment of inertia of a solid, non-wound, golf ball by varying the weight arrangement and composition of the pressurized core (preferably the inner spherical center). By varying the weight, size and density of the components of the golf ball, the moment of inertia of a golf ball can be decreased or increased. Additionally, different types of matrix materials and/or cross-linking agents, or lack thereof, can be utilized in the core construction in order to produce an overall solid, non-wound, golf ball exhibiting enhanced spin and feel while maintaining resiliency and durability.

In one other further aspect, the subject matter of the present invention provides a multi-layered covered golf ball comprising a dual core and a multi-layer cover. The dual core comprises a pressurized low or high density spherical center core layer and at least one outer core layer having a similar or different density. Preferably, the spherical center has a specific gravity of from about 0.02 to about 4.0, preferably about 0.10 to 2.0, and most preferably, about 0.30–1.0. The spherical center has a diameter from 0.15 inches to 1.0 inches, preferably about 0.25 inches to 0.75 inches and most preferably 0.0340 inches to 0.344 inches.

The golf balls of the present inventions having the foamed, pressurized nucleus are more durable and softer with an increased resilience than solid metal nucleus balls. The specific gravity of the center, or nucleus, is dependent upon the extent of foaming or cell size, the quantity and type of the material in nucleus, the amount and type of blowing agent, and the specific gravity of the chosen filler (if desired) so that the maximum U.S.G.A. golf ball weight is not exceeded.

These and other objects and features of the invention will be apparent from the following description and from the claims.

BRIEF DESCRIPTION OF THE DRAWINGS

The following is a brief description of the drawings which are presented for the purposes of illustrating the invention and not for the purposes of limiting the same.

DETAILED DESCRIPTION OF THE PREFERRED EMBODIMENTS

Figure 1:
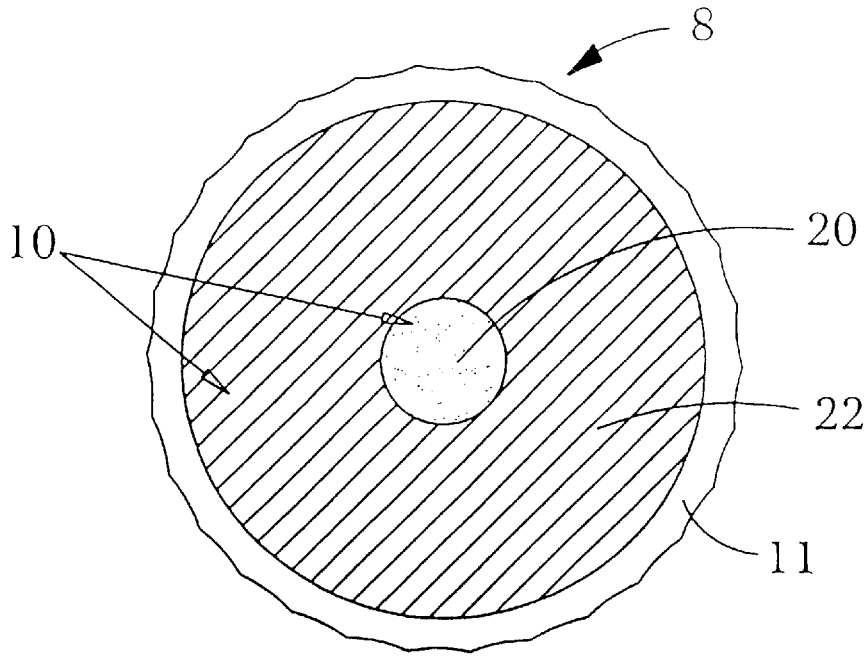
FIG. 1 is a cross-sectional view of a preferred embodiment golf ball in accordance with the present invention comprising a dual core component having a pressurized, spherical center comprising foamed cells dispersed in a first matrix material selected from thermosets, thermoplastics, or a combination thereof, an outer core layer comprising a second matrix material selected from thermosets, thermoplastics, or a combination thereof, and a single-layered cover.

The present invention is directed to improved solid, non-wound, golf balls comprising a polymeric core component with a pressurized center, or nucleus, and one or more outer core layers and a polymeric cover component with either a single or multi-layer cover. Preferably, the pressurized center core component has a relatively low density. The golf balls of the present invention can be of standard or enlarged size.

In this regard, in the present invention, the nucleus is pressurized in-situ during the molding process of the surrounding core stock. Preferably, a small "plug" or "pill" of polymeric material containing a blowing agent is inserted into the middle of two uncured preformed hollow core halves. Both halves are cured together under heat and pressure to decompose the blowing agent and cure the rubber matrix and core stock. Alternately, the two hollow halves may be cured separately and joined together with rubber adhesive with the plug or pill of polymeric material containing the blowing agent inside. The assembly is reheated in a metal mold under pressure to decompose the blowing agent and release the gas pressure.

As explained herein, the resulting center core component is pressurized and exhibits a foam-like structure comprising a plurality of cells. These terms are defined as follows. The term "pressurized" as used herein refers to the center core component being at a relatively high pressure, and one that is greater than atmospheric pressure. As described herein, the preferred embodiment of the center core component is in the form of a matrix of cross-linked polymer. The center core component includes a plurality of relatively small voids or interior hollow spaces defined throughout the matrix. These voids or spaces are referred to herein as "cells" and are described in greater detail herein. The resulting structure of the described matrix is also generally referred to herein as "foamed" or obtained by subjecting the center core component to a foaming process. The interior voids or cells, as described in greater detail herein, contain one or more gases. And, the term "pressurized" refers to the pressure of that gas within the cells as being greater than atmospheric pressure.

The golf balls of the present invention utilize a unique dual or multi-component core configuration. Preferably, the core comprises (i) an interior spherical center component formed from a blend including a first matrix material such as a thermoset material, a thermoplastic material, or combinations thereof; a blowing agent and a cross-linking agent and (ii) a core layer disposed about the spherical center component, the core layer formed from a second matrix material such as a thermoset material, a thermoplastic material, or combinations thereof. The cores may further comprise (iii) an optional outer core layer(s) disposed about the core layer. The outer core layer may be formed from a third matrix material such as a thermoset material, a thermoplastic material, or combinations thereof. The first, second or third matrix materials can be of the same or different materials.

The center core component has a specific gravity of from about 0.02 to about 4.0, and preferably about 0.10 to 2.0, most preferably, from about 0.30 to about 1.0. The weight of the remaining components are adjusted so that the ball will not exceed the U.S.G.A. golf ball weight requirement.

In this regard, the present invention is directed to golf balls comprising a dual core component having a pressurized foamed spherical center having a diameter of from about 0.15 to 1.0 inches, preferably about 0.25 to 0.75 inches. Most preferably, the pressurized formed spherical center has a diameter of about 0.340 to 0.344 inches. The pressurized foamed center is formed from in a first matrix material selected from thermosets, thermoplastics, and combinations thereof, a blowing or gas releasing agent and a cross-linking agent. Preferably, the first matrix material is a polyisoprene.

An outer core layer is then disposed about the spherical center. The outer core layer comprises a second matrix material selected from thermosets, thermoplastics, and combinations thereof. Preferably, this second matrix material is a polybutadiene. The outer diameter of the core is from about 1.25" to 1.60", and most preferably, 1.47" to 1.56". A cover comprising one or more layers is subsequently molded about the dual core component to form a solid, non-wound golf ball.

In a particularly preferred form of the present invention, the golf ball comprises a dual core assembly that includes a pressurized and relatively small but light-weight spherical center component, a thick core layer disposed about the spherical center component, and a cover assembly disposed about the dual core assembly. The light-weight center of the core preferably comprises a foamed polyisoprene rubber having an effective amount of cells dispersed throughout the center core component to produce the compression and feel desired.

The cover assembly may include a single cover or a multi-layered cover configuration. Preferably, the multi-layer golf ball covers of the present invention include a first or inner layer or ply of a high acid (greater than 16 weight percent acid) ionomer blend or a low acid (16 weight percent acid or less) ionomer blend and second or outer layer or ply comprised of a comparatively softer, low modulus ionomer, ionomer blend or other non-ionomeric thermoplastic or thermosetting elastomer such as polyurethane or polyester elastomer. Most preferably, the inner layer or ply includes a blend of low and/or high acid ionomers and has a Shore D hardness of 58 or greater and the outer cover layer is comprised of ionomer or polyurethane and has a Shore D hardness of at least 1 point softer than the inner layer.

Although the present invention is primarily directed to solid, non-wound, golf balls comprising a dual core component and a multi-layer cover as described herein, the present invention also includes golf balls having a dual core component and conventional covers comprising ionomer, balata, various thermoplastic polyurethanes, cast polyurethanes, or any other cover materials capable of being cross-linked via radiation after cover molding.

Accordingly, the present invention is directed to golf balls having a dual-core configuration and a single or multi-layer cover which produces, upon molding each layer around a pressurized inner center, a golf ball exhibiting enhanced feel (i.e., compression) without adversely affecting the ball's resiliency (i.e., distance) and/or durability (i.e., cut resistance, scuff resistance, etc.) characteristics.

The term resilience is generally defined as the ability of a strained body, by virtue of high yield strength and low elastic modulus, to recover its size and form following deformation. Simply stated, resilience is a measure of the energy retained to the energy lost when the ball is impacted with the club.

In the field of golf ball production, resilience is determined by the coefficient of restitution (C.O.R.), the constant "e" which is the ratio of the relative velocity of an elastic sphere after direct impact to that before impact. As a result, the coefficient of restitution ("e") can vary from 0 to 1, with 1 being equivalent to a perfectly or completely elastic collision and 0 being equivalent to a perfectly or completely inelastic collision.

Resilience (C.O.R.), along with additional factors such as club head speed, club head mass, angle of trajectory, ball size, density, composition and surface configuration (i.e., dimple pattern and area of coverage) as well as environmental conditions (i.e., temperature, moisture, atmospheric pressure, wind, etc.) generally determine the distance a golf ball will travel when hit. Along this line, the distance a golf ball will travel under controlled environmental conditions is a function of the speed and mass of the club and the size, density, composition and resilience (C.O.R.) of the ball and other factors. The velocity of the club, the mass of the club and the angle of the ball's departure are essentially provided by the golfer upon striking. Since club head, club head mass, the angle of trajectory and environmental conditions are not determinants controllable by golf ball producers and the ball size and weight are set by the U.S.G.A., these are not factors of principal concern among golf ball manufacturers. The factors or determinants of interest with respect to improved distance are generally the coefficient of restitution (C.O.R.), spin and the surface configuration (dimple pattern, ratio of land area to dimple area, etc.) of the ball.

The coefficient of restitution (C.O.R.) in solid core balls (i.e., molded cores and covers) is a function of the composition of the molded core and of the cover. The molded core and/or cover may be comprised of one or more layers such as in multi-layered balls.

In balls containing a wound core (i.e., balls comprising a liquid or solid center, elastic windings, and a cover), the coefficient of restitution is a function of not only the composition of the center and cover, but also the composition and tension of the elastomeric windings. As in the solid core balls, center and cover of a wound core ball may also consist of one or more layers.

The resilience or coefficient of restitution of a golf ball can be analyzed by determining the ratio of the outgoing velocity to the incoming velocity. In the examples of this writing, the coefficient of restitution of a golf ball was measured by propelling a ball horizontally at a speed of 125+/−1 feet per second (fps) against a generally vertical, hard, flat steel plate and measuring the ball's incoming and outgoing velocities electronically. Speeds were measured with a pair of Oehler Mark 55 ballistic screens (available from Oehler Research Austin Tex.), which provide a timing pulse when an object passes through them. The screens are separated by 36" and are located 25.25" and 61.25" from the rebound wall. The ball speed was measured by timing the pulses from screen 1 to screen 2 on the way into the rebound wall (as the average speed of the ball over 36"), and then the exit speed was timed from screen 2 to screen 1 over the same distance. The rebound wall was tilted 2 degrees from a vertical plane to allow the ball to rebound slightly downward in order to miss the edge of the cannon that fired it.

As indicated above, the incoming speed should be 125+/−1 fps. Furthermore, the correlation between C.O.R. and forward or incoming speed has been studied and a correction has been made over the +/− fps range so that the C.O.R. is reported as if the ball had an incoming speed of exactly 125.0 fps.

The coefficient of restitution must be carefully controlled in all commercial golf balls if the ball is to be within the specifications regulated by the U.S.G.A. As discussed to some degree above, the U.S.G.A. standards indicate that a "regulation" ball cannot have an initial velocity exceeding 255 feet per second in an atmosphere of 75° F. when tested on a U.S.G.A. machine. Since the coefficient of restitution of a ball is related to the ball's initial velocity, it is highly desirable to produce a ball having sufficiently high coefficient of restitution (C.O.R.) to closely approach the U.S.G.A. limit on initial velocity, while having an ample amount of softness (i.e., hardness) to produce the desired degree of playability (i.e., spin, etc.).

Furthermore, as mentioned above, the maximum distance a golf ball can travel (carry and roll) when tested on a U.S.G.A. driving machine set at a club head speed of 160 feet/second is 296.8 yards. While golf ball manufacturers design golf balls which closely approach this driver distance specification, there is no upper limit for how far an individual player can drive a ball. Thus, while golf ball manufacturers produce balls having certain resilience characteristics in order to approach the maximum distance parameter set by the U.S.G.A. under controlled conditions, the overall distance produced by a ball in actual play will vary depending on the specific abilities of the individual golfer.

The surface configuration of a ball is also an important variable in affecting a ball's travel distance. The size and shape of the ball's dimples, as well as the overall dimple pattern and ratio of land area to dimpled area are important with respect to the ball's overall carrying distance. In this regard, the dimples provide the lift and decrease the drag for sustaining the ball's initial velocity in flight as long as possible. This is done by displacing the air (i.e., displacing the air resistance produced by the ball from the front of the ball to the rear) in a uniform manner. Moreover, the shape, size, depth and pattern of the dimple affect the ability to sustain a ball's initial velocity.

Additionally, compression is another property involved in the overall performance of a golf ball. The compression of a ball will influence the sound or "click" produced when the ball is properly hit. Similarly, compression can effect the "feel" of the ball (i.e., hard or soft responsive feel), particularly in chipping and putting.

Moreover, while compression by itself has little bearing on the distance performance of a ball, compression can affect the playability of the ball on striking. The degree of compression of a ball against the club face and the softness of the cover strongly influence the resultant spin rate. Typically, a softer cover will produce a higher spin rate than a harder cover. Additionally, a harder core will produce a higher spin rate than a softer core. This is because at impact a hard core serves to compress the cover of the ball against the face of the club to a much greater degree than a soft core thereby resulting in more "grab" of the ball on the clubface and subsequent higher spin rates. In effect the cover is squeezed between the relatively incompressible core and clubhead. When a softer core is used, the cover is under much less compressive stress than when a harder core is used and therefore does not contact the clubface as intimately. This results in lower spin rates.

The term "compression" utilized in the golf ball trade generally defines the overall deflection that a golf ball undergoes when subjected to a compressive load. For example, PGA compression indicates the amount of change in golf ball's shape upon striking.

The development of solid core technology in two-piece balls has allowed for much more precise control of compression in comparison to thread wound three-piece balls. This is because in the manufacture of solid core balls, the amount of deflection or deformation is precisely controlled by the chemical formula used in making the cores. This differs from wound three-piece balls wherein compression is controlled in part by the winding process of the elastic thread. Thus, two-piece and multi-layer solid core balls exhibit much more consistent compression readings than balls having wound cores such as the thread wound three-piece balls.

Additionally, cover hardness and thickness are important in producing the distance, playability and durability properties of a golf ball. As mentioned above, cover hardness directly affects the resilience and thus distance characteristics of a ball. All things being equal, harder covers produce higher resilience. This is because soft materials detract from resilience by absorbing some of the impact energy as the material is compressed on striking.

However, soft covered balls are generally preferred by the more skilled golfer because he or she can impart high spin rates that give him or her better control or workability of the ball. Spin rate is an important golf ball characteristic for both the skilled and unskilled golfer. As mentioned, high spin rates allow for the more skilled golfer, such as PGA and LPGA professionals and low handicap players, to maximize control of the golf ball. This is particularly beneficial to the more skilled golfer when hitting an approach shot to a green. The ability to intentionally produce "back spin", thereby stopping the ball quickly on the green, and/or "side spin" to draw or fade the ball, substantially improves the golfer's control over the ball. Thus, the more skilled golfer generally prefers a golf ball exhibiting high spin rate properties.

The term or designation "2×2" or "2×2 construction" as used herein refers to a golf ball construction utilizing two central core components, e.g. a central core component and a core layer disposed about the core component, and two cover components, e.g. a first inner cover layer and a second outer cover layer. The present invention however is not limited to 2×2 configurations and includes 2×1 (two core components and a single cover component), 3×2 (three core components and two cover components), 2×3 configurations (two core components and three cover components), 3×3 configurations (three core components and three cover components), and additional configurations such as 4×2, 4×3, 4×4, 2×4, 3×4, . . . etc.

The term "moment of inertia," sometimes designated "MOI" herein, for the golf balls of the present invention is defined as the sum of the products formed by multiplying the mass of each element by the square of its distance from a specified line or point. This is also known as rotational inertia. Since the present invention golf balls comprise a number of components, the MOI of the resulting golf ball is equal to the sum of the moments of inertia of each of its various components, taken about the same axis or point. All of the moments of inertia of golf balls referred to herein are with respect to, or are taken with regard to, the geometric center of the golf ball.

Figure 2:
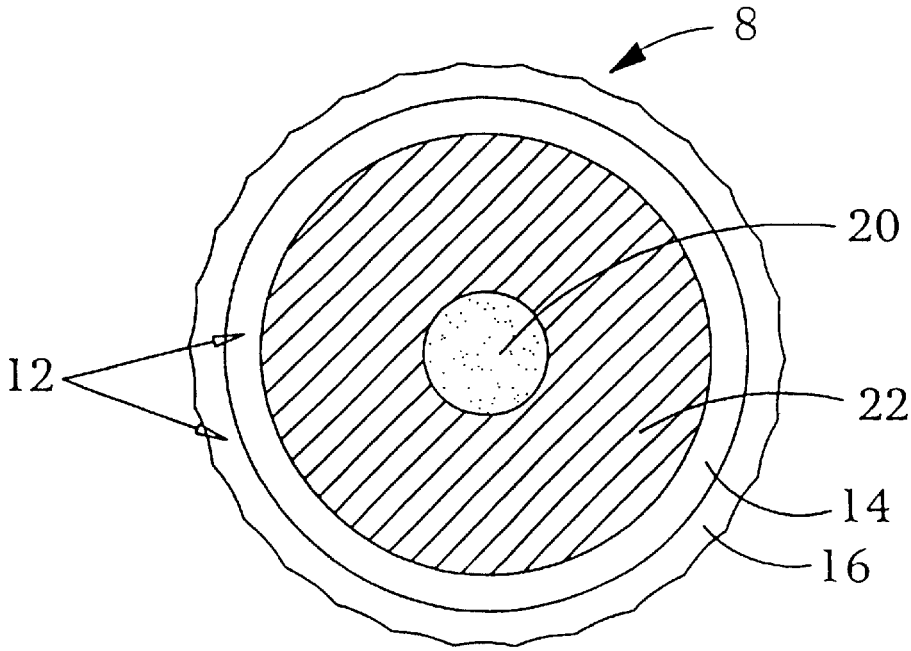
FIG. 2 is a cross-sectional view of yet another preferred embodiment golf ball in accordance with the present invention comprising a dual core component having a pressurized, spherical center comprising foamed cells dispersed in a first matrix material selected from thermosets, thermoplastics, or a combination thereof, an outer core layer comprising a second matrix material selected from thermosets, thermoplastics, or a combination thereof, an inner cover layer and an outer cover layer.

FIGS. 1 and 2 illustrate preferred embodiments of the golf balls in accordance with the present invention. It will be understood that all of the figures referenced herein are schematic in nature and none of the referenced figures are to scale. And so, the thicknesses and proportions of the various layers and the diameter of the various core components are not necessarily as depicted.

The golf ball 8 comprises a single layer 11 (FIG. 1) or a multi-layered cover 12 (FIG. 2) disposed about a core 10. The core 10 of the golf ball is formed of a pressurized foamed spherical or center core layer center 20, preferably having a low density, and an outer core layer 22. The low density spherical center 20 is designed to produce a greater resilience and feel characteristics.

The multi-layered cover 12 (FIG. 2) comprises two layers: a first or inner layer or ply 14 and a second or outer layer or ply 16. The inner layer 14 can be ionomer, ionomer blends, non-ionomer, non-ionomer blends, or blends of ionomer and non-ionomer. The outer layer 16 is softer than the inner layer and can be ionomer, ionomer blends, non-ionomer, non-ionomer blends or blends of ionomer and non-ionomer.

In a first multi-layered cover embodiment, the inner layer 14 is comprised of a high acid (i.e. greater than 16 weight percent acid) ionomer resin or high acid ionomer blend. Preferably, the inner layer is comprised of a blend of two or more high acid (i.e., at least 16 weight percent acid) ionomer resins neutralized to various extents by different metal cations. The inner cover layer may or may not include a metal stearate (e.g., zinc stearate) or other metal fatty acid salt. The purpose of the metal stearate or other metal fatty acid salt is to lower the cost of production without affecting the overall performance of the finished golf ball.

In a second multi-layered cover embodiment, the inner layer 14 is comprised of a low acid (i.e., 16 weight percent acid or less) ionomer blend. Preferably, the inner layer is comprised of a blend of two or more low acid (i.e., 16 weight percent acid or less) ionomer resins neutralized to various extents by different metal cations. The inner cover layer may or may not include a metal stearate (i.e., zinc stearate) or other metal fatty acid salt.

It has been found that a hard inner layer in the multi-cover embodiment provides for a substantial increase in resilience (i.e., enhanced distance) over known multi-layer covered balls. The softer outer layer along with the particular multi-component core of the present invention provides the desirable "feel" and high spin rate characteristic while maintaining the golf ball's resiliency. The softer outer layer allows the cover to deform more during impact and increases the area of contact between the club face and the cover, thereby imparting more spin on the ball. As a result, the soft cover provides the ball with a balata-like feel and playability characteristics with improved distance and durability.

Consequently, the overall combination of the pressurized foamed inner center, one or more outer core layers and the inner and outer cover layers results in a golf ball having enhanced resilience (and improved soft feel due to the foamed rubber nucleus).

Figure 3:
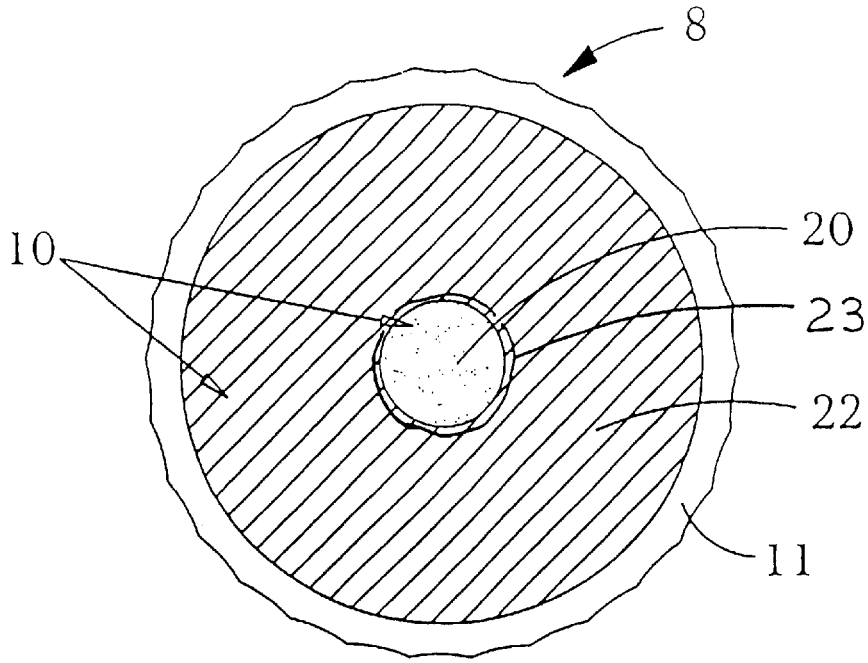
FIGS. 3 and 4 are the same as FIGS. 1 and 2 above, respectively, with an additional layer around the pressurized nucleus to reduce or eliminate pressure loss, over time, of the gas contained in the nucleus.
Figure 4:
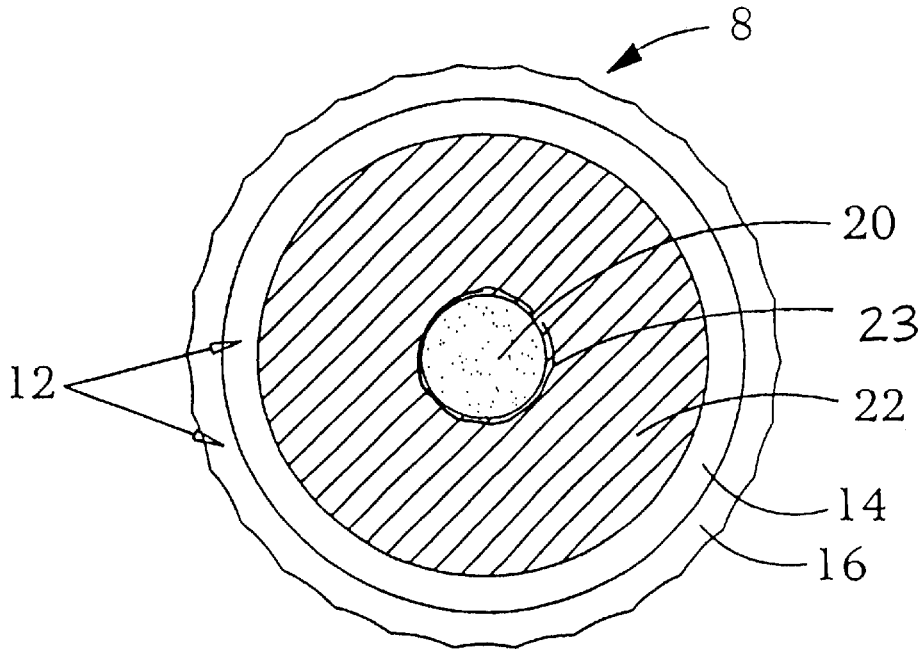

FIGS. 3 and 4 relate to further preferred embodiments of the present invention, where in a layer 23 is included around the pressurized nucleus 20 to reduce or eliminate pressure loss, over time, of the gas contained in the nucleus.

The specific components and characteristics of the solid, non-wound golf balls of the present invention are more particularly set forth below.

Core Assembly

As noted, the present invention golf balls utilize a unique dual core configuration. Preferably, the cores comprise (i) an inner, pressurized, spherical center or center core layer component formed from a first matrix material comprised of thermoset material, thermoplastic material, or combinations thereof, blowing agent(s) and a cross-linking agent(s), and (ii) an outer core layer disposed about the spherical center component, the core layer being formed from a second matrix material comprised of thermoset material, thermoplastic material, or combinations thereof.

More preferably, the pressurized core component of the present invention consists of a foamed, spherical center and comprises a mixed or blended matrix of polyisoprene, cross-linking agent(s) and blowing agent(s). As indicated below, other polymeric materials can also be utilized. The ingredients of the center core component are mixed together and formed into a spherical shape and then encapsulated within at least one outer core layer. The resulting assembly is then molded under heat and pressure. Heating causes cross-linking of the polyisoprene to occur and also results in activation of the blowing agent (i.e. conversion into a gaseous state). This process and the resulting foamed matrix are described in greater detail below.

The gas phase in the foamed core component is distributed in voids, pores, or pockets referred to herein as cells. If these cells are interconnected in such a manner that gas can pass from one to another, the material is termed open-celled. If the cells are discrete and the gas phase of each is independent of that of the other cells, the material is termed closed-celled.

For example, hydrazide blowing agents such as Celogen® TSH release nitrogen gas ($N_2$) to produce closed cells. In turn, sodium bicarbonate and ammonium carbonate release $CO_2$ gas to produce open cells. Nitrogen gas is preferred in the present invention as it has much lower permeability than carbon dioxide.

The nomenclature of cellular polymers is not standardized. Classifications have been made according to the properties of the base polymer, the methods of manufacture, the cellular structure, or some combination of these.

The foamed core component can be prepared by a variety of methods. The most preferred process comprises expanding a fluid polymer phase to a low density cellular state and then preserving this state. This is the foaming or expanding process.

The expansion process generally includes three steps: creating small discontinuities or cells in a fluid or plastic phase; causing these cells to grow to a desired volume; and stabilizing this cellular structure by physical or chemical means such as peroxides or cross-linking agents.

The initiation or nucleation of cells is the formation of cells of such size that they are capable of growth under the given conditions of foam expansion. Generally, the growth of a hole or cell in a fluid medium at equilibrium is controlled by the pressure difference between the inside and the outside of the cell, the surface tension of the fluid phase, and the radius of the cell. The pressure outside the cell is the pressure imposed on the fluid surface by its surroundings. The pressure inside the cell is the pressure generated by the blowing agent dispersed or dissolved in the polymer matrix. If blowing pressures are low, the radii of initiating cells must be large. The hole that acts as an initiating site can be filled with either a gas or a solid that breaks the fluid surface and thus enables blowing agent to surround it.

During the time of cell growth in a foam, a number of properties of the system change greatly. Cell growth can, therefore, be treated only qualitatively. The following considerations are of primary importance: (1) the fluid viscosity is changing considerably, influencing both the cell growth rate and the flow of polymer to intersections from cell walls leading to collapse; (2) the pressure of the blowing agent decreases, falling off less rapidly than an inverse volume relationship because new blowing agent diffuses into the cells as the pressure falls off; (3) the rate of growth of the cell depends on the viscoelastic nature of the polymer phase, the blowing agent pressure, the external pressure on the foam, and the permeation rate of blowing agent through the polymer phase; and (4) the pressure in a cell of small radius is greater than that in a cell of larger radius.

The increase in surface area corresponding to the formation of many cells in the plastic phase is accompanied by an increase in the free energy of the system; hence the foamed state is inherently unstable. Methods of stabilizing this foamed state can be classified as chemical, e.g. the polymerization of a fluid resin into a three-dimensional thermoset polymer, or physical, e.g. the cooling of an expanded thermoplastic polymer to a temperature below its melting point to prevent polymer flow.

Concerning chemical stabilization, the chemistry of the system determines both the rate at which the polymer phase is formed and the rate at which it changes from a viscous fluid to a dimensionally stable cross-linked polymer phase. It also governs the rate at which the blowing agent is activated, whether it is due to temperature rise or to insolubilization in the liquid phase.

The blowing agent should have a lower decomposition temperature than the decomposition temperature of the peroxide or cross-linking agent so that cells are formed first, then cross-linked to stabilize the structure.

The type and amount of blowing agent governs the amount of gas generated, the rate of generation, the pressure that can be developed to expand the polymer phase, and the amount of gas lost from the system relative to the amount retained in the cells.

Additives to the foaming system (cell growth-control agents) can greatly influence nucleation of foam cells, either through their effect on the surface tension of the system, or by acting as nucleating sites from which cells can grow. They can influence the mechanical stability of the final solid foam structure considerably by changing the physical properties of the plastic phase and by creating discontinuities in the plastic phase that allow blowing agent to diffuse from the cells to the surroundings. Environmental factors such as temperature and pressure also influence the behavior of thermoset foaming systems.

As to physical stabilization, the factors are essentially the same as for chemically stabilized systems but for somewhat different reasons. Chemical composition of the polymer phase determines the temperature at which foam must be produced, the type of blowing agent required, and the cooling rate of the foam necessary for dimensional stabilization. Blowing agent composition and concentration controls the rate at which gas is released, the amount of gas released, the pressure generated by the gas, escape or retention of gas from the foam cells for a given polymer, and heat absorption or release owing to blowing agent activation.

Additives have the same effect on thermoplastic foaming processes as on thermoset foaming processes. Environmental conditions are important in this case because of the necessity of removing heat from the foamed structure in order to stabilize it. The dimensions and size of the foamed structure are important for the same reason.

The following is an exemplary description for forming a preferred embodiment pressurized core component in accordance with the present invention. A decomposable blowing agent, along with vulcanizing systems and other additives, is compounded with the uncured elastomer at a temperature below the decomposition temperature of the blowing agent. When the uncured elastomer is heated in a forming mold, it undergoes a viscosity change. The blowing agent and vulcanizing systems are chosen to yield preferably closed-celled cellular rubber from the release of nitrogen gas from blowing agents such as 2,2'-azobisisobutyronitrile, azodicarbonamide, 4,4'-oxy-bis(benzenesulfonyl hydrazide), and dinitrosopentamethylenete-tramine. Sodium bicarbonate produces an open cell structure with $CO_2$ gas.

A preferred blowing or foaming agent for use in forming the center cores described herein is Celogen® TSH. This is available from Crompton Uniroyal Chemical of Naugatuck Conn. Celogen® TSH is p-toluene sulfonyl hydrazide. Various data associated with this agent is set forth below:

| | |
|---|---|
| Form: | White powder. |
| Specific Gravity: | 1.48 at 25° C. (77° F.) |
| Melting Point: | 105–120° C. (221–248° F.) |
| Decomposition Point: | 140–150° C. (284–302° F.) |
| Gas Yield: | 115 cc/gram at 150° C. (302° F.) |
| Decomposition Gases: | $N_2$ and $H_2O$ |
| Activated by: | Weak activators including peroxides, treated urea (BIK ® OT) and triethanolamine. Not readily activated by conventional activation systems for chemical foaming agents. |
| Discoloration: | Nondiscoloring; decomposition residue is white. |
| Solubility: | Soluble in aqueous acids, bases and alcohols. Insoluble in water. Reacts with ketones and dimethyl formamide. |

The timing for blowing-agent decomposition should occur first before the cross-linking initiates.

The spherical center component may further comprise a blend of one or more heavy weight metals and/or filler materials preferably in particulate or powder form, dispersed throughout the thermoset or thermoplastic material to increase the specific gravity if desired.

As shown in FIGS. 1 and 2, the outer core layer is disposed immediately adjacent to, and in intimate contact with the center component. In an alternative embodiment, see FIGS. 3 and 4, a barrier layer is used to reduce the permeability of the gas through the outer layers. The matrix material of the spherical center and the core layers may be of similar or different composition.

The core layers of the golf balls of the present invention generally are more resilient than that of the cover layers, exhibiting a PGA compression of about 85 or less, preferably about 30 to 85, and more preferably about 40–60.

The core compositions and resulting molded core layers of the present invention are manufactured using relatively conventional techniques. In this regard, the core compositions of the invention preferably are based on a variety of materials, particularly the conventional rubber based materials such as cis-1,4 polybutadiene and mixtures of polybutadiene with other elastomers blended together with cross-linking agents, a free radical initiator, optional specific gravity controlling fillers and the like.

Natural rubber, isoprene rubber, EPR, EPDM, styrene-butadiene rubber, or similar thermoset materials may be appropriately incorporated into the base rubber composition of the butadiene rubber to form the rubber component. It is preferred to use isoprene rubber as the base material for the central core component. Butyl and halobutyl rubber may also be used to reduce the gas permeability if no barrier layer is used. If maximum shelf life is desired to preserve the internal gas pressure, the golf balls may be packaged in pressurized cans, similar to tennis balls and hand balls. It is preferred to use butadiene rubber as a base material of the composition for the outer core layer as it produces maximum C.O.R. Different compositions can readily be used in the different layers, including thermoplastic materials such as a thermoplastic elastomer or a thermoplastic rubber, or a thermoset rubber or thermoset elastomer material.

Some examples of materials suitable for use as an outer core layer include the above materials as well as polyether or polyester thermoplastic urethanes, thermoset polyurethanes or metallocene polymers or blends thereof. For example, suitable metallocene polymers include foams of thermoplastic elastomers based on metallocene single site catalyst based foams. Such metallocene based foam resins are commercially available and are readily suitable for forming the outer core layer.

Examples of a thermoset material include a rubber based, castable urethane or a silicone rubber. The silicone elastomer may be any thermoset or thermoplastic polymer comprising, at least partially, a silicone backbone. Preferably, the polymer is thermoset and is produced by intermolecular condensation of silanols. A typical example is a polydimethylsiloxane cross-linked by free radical initiators, or by the cross-linking of vinyl or allyl groups attached to the silicone through reaction with silylhydride groups, or via reactive end groups. The silicone may include a reinforcing or non-reinforcing filler. Additionally, the present invention also contemplates the use of a polymeric foam material, such as the metallocene based foamed resin for the outer core layers.

More particularly, a wide array of thermoset materials can be utilized in the core components of the present invention. Examples of suitable thermoset materials include polybutadiene, polyisoprene, styrene/butadiene, ethylene propylene diene terpolymers, natural rubber polyolefins, polyurethanes, silicones, polyureas, or virtually any irreversibly cross-linkable resin system. It is also contemplated that epoxy, phenolic, and an array of unsaturated polyester resins could be utilized.

The thermoplastic material utilized in the present invention golf balls and, particularly their dual cores, may be nearly any thermoplastic material. Examples of typical thermoplastic materials for incorporation in the golf balls of the present invention include, but are not limited to, ionomers, polyurethane thermoplastic elastomers, and combinations thereof. It is also contemplated that a wide array of other thermoplastic materials could be utilized, such as polysulfones, polyamide-imides, polyarylates, polyaryletherketones, polyaryl sulfones/polyether sulfones, polyether-imides, polyimides, liquid crystal polymers, polyphenylene sulfides; and specialty high-performance resins, which would include fluoropolymers, polybenzimidazole, and ultra-high molecular weight polyethylenes.

Additional examples of suitable thermoplastics include metallocenes, polyvinyl chlorides, polyvinyl acetates, acrylonitrile-butadiene-styrenes, acrylics, styrene-acrylonitriles, styrene-maleic anhydrides, polyamides (nylons), polycarbonates, polybutylene terephthalates, polyethylene terephthalates, polyphenylene ethers/polyphenylene oxides, reinforced polypropylenes, and high-impact polystyrenes.

Preferably, the thermoplastic materials have relatively high melting points, such as a melting point of at least about 300° F. Several examples of these preferred thermoplastic materials and which are commercially available include, but are not limited to, Capron™ (a blend of nylon and ionomer), Lexan™ polycarbonate, Pebax®, polyether amide, and Hytrel™ polyester amide. The polymers or resin system may be cross-linked by a variety of means such as by peroxide agents, sulphur agents, radiation or other cross-linking techniques, if applicable. However, the use of peroxide cross-linking agents is generally preferred in the present invention.

Any or all of the previously described components in the cores of the golf ball of the present invention may be formed in such a manner, or have suitable fillers added, so that their resulting density is decreased or increased. For example, heavy weight metals and/or filler materials can be optionally incorporated into the inner spherical center. This is discussed in more detail herein.

Additionally, the inner core component may be formed or otherwise produced to be light in weight. For instance, the components could be foamed, either separately or in-situ. Related to this, a foamed light weight filler agent or density reducing filler may also be added to the outer core layers.

The preferred core composition for the center core component comprises polyisoprene, a peroxide cross-linking agent, and an effective amount of a blowing agent. A most preferred type of polyisoprene is Natsyn™ 2200, available from The Goodyear Tire & Rubber Co., Akron, Ohio.

The core compositions for the one or more core layers of the invention may also be based on polybutadiene, and mixtures of polybutadiene with other elastomers. It is preferred that the base elastomer have a relatively high molecular weight. The broad range for the molecular weight of suitable base elastomers is from about 50,000 to about 500,000. A more preferred range for the molecular weight of the base elastomer is from about 100,000 to about 500,000. As a base elastomer for the core layer (or outer core) composition, cis-polybutadiene is preferably employed, or a blend of cis-polybutadiene with other elastomers such as polyisoprene may also be utilized. Most preferably, cis-polybutadiene having a weight-average molecular weight of from about 100,000 to about 500,000 is employed.

Along this line, it has been found that the high cis-polybutadiene manufactured and sold by Dow France 13131 Berre I'Etang Cedex, France, tradename Cariflex BR-1220, either alone or in combination with a polyisoprene, such as Natsyn™ 2200, is particularly well suited.

Metal carboxylate cross-linking agents may be used for the various core layers. The unsaturated carboxylic acid component of the core composition (a co-cross-linking agent) is the reaction product of the selected carboxylic acid or acids and an oxide or carbonate of a metal such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Exemplary of the unsaturated carboxylic acids which find utility in the present core compositions are acrylic acid, methacrylic acid, itaconic acid, crotonic acid, sorbic acid, and the like, and mixtures thereof. Preferably, the acid component is either acrylic or methacrylic acid. Usually, from about 12 to about 40, and preferably from about 15 to about 35 parts by weight of the carboxylic acid salt, such as zinc diacrylate, is included in the outer core layers. The unsaturated carboxylic acids and metal salts thereof are generally soluble in the elastomeric base, or are readily dispersed.

The free radical initiator included in the core compositions is any known polymerization initiator (a co-cross-linking agent) which decomposes during the cure cycle. The term "free radical initiator" as used herein refers to a chemical which, when added to a mixture of the elastomeric blend and a metal salt of an unsaturated, carboxylic acid, promotes cross-linking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present invention, generally in amounts of from about 0.5 to about 4.0 and preferably in amounts of from about 1.0 to about 3.0 parts by weight per each 100 parts of elastomer and based on 40% active peroxide with 60% inert filler.

Exemplary of suitable peroxides for the purposes of the present invention are dicumyl peroxide, n-butyl 4,4'-bis (butylperoxy)valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

Examples of such commercially available peroxides are Luperco™ 230 or 231 XL sold by Atochem, Lucidol Division, Buffalo, N.Y., and Trigonox™ 17/40 or 29/40 sold by Akzo Chemie America, Chicago, Ill. In this regard Luperco™ 230 XL and Trigonox™ 17/40 are comprised of n-butyl 4,4-bis(butylperoxy)valerate; and, Luperco™ 231 XL and Trigonox™ 14/40 are comprised of 1,1-bis(t-butylperoxy)-3,3,5-trimethyl cyclohexane. The one hour half life of Luperco™ 231 XL is about 112° C., and the one hour half life of Trigonox™ 17/40 is about 129° C. Trigonox™ 42–40 B is preferred and is chemically tert-butyl peroxy-3,5,5, trimethyl hexanoate.

The core compositions of the present invention may additionally contain any other suitable and compatible modifying ingredients including, but not limited to, metal oxides, fatty acids, diisocyanates and polypropylene powder resin. For example, Papi™ 94, a polymeric diisocyanate, commonly available from Dow Chemical Co., Midland, Mich., is an optional component in the rubber compositions. It can range from about 0 to 5 parts by weight per 100 parts by weight rubber (phr) component, and it acts as a moisture scavenger. In addition, it has been found that the addition of a polypropylene powder resin results in a core which is harder (i.e. exhibits low compression) and thus allows for a reduction in the amount of cross-linking agent utilized to soften the core to a normal or below normal compression.

Various activators may also be included in the compositions of the present invention. For example, zinc oxide, calcium oxide and/or magnesium oxide are activators for the polybutadiene. The activator can range from about 2 to about 30 parts by weight per 100 parts by weight of the rubbers (phr) component.

Fatty acids or metallic salts of fatty acids may also be included in the compositions, functioning to improve moldability and processing. Generally, free fatty acids having from about 10 to about 40 carbon atoms, and preferably having from about 15 to about 20 carbon atoms, are used. Exemplary of suitable fatty acids are stearic acid and linoleic acids, as well as mixtures thereof. Exemplary of suitable metallic salts of fatty acids include zinc stearate. When included in the core compositions, the fatty acid component is present in amounts of from about 1 to about 25, preferably in amounts from about 2 to about 15 parts by weight based on 100 parts rubber (elastomer).

It is preferred that the core compositions include zinc stearate as the metallic salt of a fatty acid in an amount of from about 2 to about 20 parts by weight per 100 parts of rubber.

Diisocyanates may also be optionally included in the core compositions. The diisocyanates act here as moisture scavengers. When utilized, the diioscyanates are included in amounts of from about 0.2 to about 5.0 parts by weight based on 100 parts rubber. Exemplary of suitable diisocyanates are 4,4'-diphenylmethane diisocyanate and other polyfunctional isocyanates known to the art.

Furthermore, the dialkyl tin difatty acids set forth in U.S. Pat. No. 4,844,471, the dispersing agents disclosed in U.S. Pat. No. 4,838,556, and the dithiocarbamates set forth in U.S. Pat. No. 4,852,884 may also be incorporated into the polybutadiene compositions of the present invention. The specific types and amounts of such additives are set forth in the above identified patents, which are incorporated herein by reference.

The preferred center core component of the present invention generally comprises about 100 parts by weight of a polyisoprene, and effective amounts of a cross-linker and a blowing agent. These effective amounts are described in greater detail herein. Optionally, a heavyweight filler may also be included.

The preferred outer core components of the invention are generally comprised of 100 parts by weight of a base elastomer (or rubber) selected from polybutadiene and mixtures of polybutadiene with other elastomers, such as polyisoprene, 12 to 40 parts by weight of at least one metallic salt of an unsaturated carboxylic acid, and 0.5 to 4.0 parts by weight of a free radical initiator (40% active peroxide).

In addition, various polyisoprenes may also be included in the core components of the present invention. In particular, it is preferred that one or more polyisoprenes are utilized to form the pressurized center core component of the preferred embodiment golf ball. Examples of such polyisoprenes are as follows:

| TRADENAME<br>Composition<br>Supplier | ELASTOMER PROPERTIES<br>Compounding & Processing |
|---|---|
| Isolene<br>Depolymerized synthetic<br>polyisoprene Hardman | Sp. gr. 0.92. Ash, 0.5–1.2%. Volatile matter, 0.1% (24 hour at 300° F.), 100% rubber (flowable form). Grades: Isolene-40 (40,00 cps @ 100° F.; Mol wt. mw 40,000); Isolene-75 viscosity (75,000 cps @ 100° F.); DPR-400 viscosity (400,000 @ 100° F., mol wt. mw 40,000). Gardner color (60–8) |
| Natsyn 2200<br>Goodyear<br>R. T. Vanderbilt | Sp. gr. 0.91. White, non-staining, solution polymerized, IR with excellent uniformity and purity. Vulcanized with conventional cure systems, Mooney visc (ml-4 @ 212° F.). 70–90, needs little or no breakdown. Tg. 98° F. |
| Natsyn 2205<br>DuPont<br>R. T. Vanderbilt | Sp. gr. 0.91. White, non-staining, virtually gel free solution polymerized IR. Mooney viscosity (ml-4 @ 212° F.). 70–90, needs little or no breakdown. Tg. 98° F. |
| Natsyn 2210<br>DuPont<br>R. T. Vanderbilt | Sp. gr. 0.91. White, non-staining, low Mooney, solution polymerized, IR with excellent uniformity and purity. Vulcanized with conventional cure systems, Mooney visc (ml-4 @ 212° F.) 50–65, therefore no breakdown is required. Tg-98. |
| Nipol IR 2200L<br>Goldsmith & Eggleton | Sp. gr. 0.92, Mooney visc. ml-4 at 100° C. 70, Cis 1,498%. non-staining. |
| SKI-3<br>Polyisoprene<br>H. A. Astlett | Staining IR: 97.5 cis 1,4; Mooney viscosity, density 915 ± 5. |
| SKI-3<br>Isoprene Rubber<br>Nizh USA | Mooney visc. ml-4 (100° C.) 65–85; Plasticity 0.30–0.41; ultimate elongation, % min. 800; Ultimate tensile strength MPa (kgF/sq. cm.) min at 23° C. 30.4 at 100° C. 21.6. |
| SKI-3 (Russian IR)<br>Polyisoprene<br>Alcan | Staining IR, 97.5 cis 1,4. 60 Mooney viscosity, density 915 ± 5. |
| SKI-3-S<br>Polyisoprene<br>H. A. Astlett | Non-staining 97.5 cis 1,473 ± 7 Mooney viscosity, density 915 ± 5. |
| SKI-3-S (Russian IR)<br>Polyisoprene<br>Alcan | Non-staining 97.5 cis 1,473 ± 7 Mooney viscosity, density 915 ± 5. |

Additional details relating to polyisoprenes and their processing and incorporation in golf balls are set forth in U.S. Pat. Nos. 4,144,223; 4,714,253; 5,019,319; 5,725,443; 5,989,136; 6,120,390; 6,217,462; and 6,319,152; all of which are hereby incorporated by reference.

The inner spherical center preferably can be compression or transfer molded from an uncured or lightly cured elastomer composition. To achieve higher coefficients of restitution and/or to increase hardness in the core, the manufacturer may include a small amount of a metal oxide such as zinc oxide. Non-limiting examples of other materials which may be used in the core composition include compatible rubbers or ionomers, and low molecular weight fatty acids such as stearic acid. Free radical initiator catalysts such as peroxides are admixed with the core composition so that on the application of heat and pressure, a curing or cross-linking reaction takes place.

Also optionally included in the matrix materials of the inner spherical centers and/or core layers are one or more heavyweight fillers or powder materials. Such core combinations may exhibit lower or higher moment of inertia than conventional two-piece golf balls.

The powdered metal in the core components may be in a wide array of types, geometries, forms, and sizes. The powdered metal may be of any shape so long as the metal may be blended with the other components which form the core.

Particularly, the metal may be in the form of metal particles, metal flakes, and mixtures thereof. However, again, the forms of powdered metal are not limited to such forms. The metal may be in a form having a variety of sizes so long as the objectives of the present invention are maintained. Preferably, the powdered metal is incorporated into the matrix material of the core in finely defined form, as for example, in a size generally less than about 20 mesh, preferably less than about 200 mesh and most preferably less than about 325 mesh, U.S. standard size. The amount of powdered metal included in the core is dictated by weight restrictions, the type of powdered metal, and the overall characteristics of the finished ball.

The core components may include more than one type of powdered metal. Particularly, the core components may include blends of the powdered metals disclosed below. The blends of powdered metals may be in any proportion with respect to each other in order for the spherical center and golf ball to exhibit the characteristics noted herein.

Examples of several suitable powdered metals which can be included in the present invention are as follows:

| Metals and Alloys (Powders) | Specific Gravity |
|---|---|
| titanium | 4.51 |
| tungsten | 19.35 |
| bismuth | 9.78 |
| nickel | 8.90 |
| molybdenum | 10.2 |
| iron | 7.86 |
| copper | 8.94 |
| brass | 8.2–8.4 |
| bronze | 8.70–8.74 |
| cobalt | 8.92 |
| zinc | 7.14 |
| tin | 7.31 |
| aluminum | 2.70 |

The amount and type of powdered metal utilized is dependent upon the overall characteristics of the golf ball desired. Generally, lesser amounts of high specific gravity powdered metals are necessary to produce a decrease in the moment of inertia in comparison to low specific gravity materials. Furthermore, handling and processing conditions can also affect the type of heavy weight powdered metals incorporated into the core.

The core having a two-layer structure composed of the inner core and the outer core is referred to as the solid core in the present invention. The above expression is in contrast to a thread-wound core (core formed by winding a rubber thread around the center portion which is solid or filled with a liquid material).

The double cores of the inventive golf balls typically have a coefficient of restitution of about 0.770 or more, more preferably 0.780 or more and a PGA compression of about 85 or less, preferably 70 or less, and more preferably 60 or less. The double cores have a weight of 25 to 40 grams and preferably 30 to 40 grams and a Shore C hardness of less than 80, with the preferred Shore C hardness being about 50 to 75.

As mentioned above, the present invention includes golf ball embodiments that utilize two or more core components. For example, in accordance with the present invention, a core assembly is provided that comprises a central core component and one or more core layers disposed about the central core component. Details for the second and third or more core layers are also included herein in the description of the core layer utilized in a dual core configuration.

In producing golf ball cores utilizing the present compositions, the ingredients may be intimately mixed using, for instance, two roll mills or a Banbury™ mixer until the composition is uniform, usually over a period of from about 5 to about 20 minutes. The sequence of addition of components is not critical. A preferred blending sequence is described below.

The matrix material or elastomer (such as polyisoprene for the center core component and polybutadiene for the one or more core layers), the blowing agent (if desired), the cross-linking agent (if desired), the powdered metal zinc salt (if desired), the low or high specific gravity additive such as powdered metal (if desired), metal oxide (if desired), fatty acid (if desired), the metallic dithiocarbamate (if desired), surfactant (if desired), and tin difatty acid (if desired), are blended for about 7 minutes in an internal mixer such as a Banbury™ mixer. As a result of shear during mixing, the temperature rises to about 200° F. The mixing is desirably conducted in such a manner that the composition does not reach incipient polymerization temperatures or the decomposition temperature of the blowing agent during the blending of the various components. The initiator and diisocyanate are then added and the mixing continued until the temperature reaches about 220° F. whereupon the batch is discharged onto a two roll mill, mixed for about one minute and sheeted out.

The sheet is rolled into a "pig" and then placed in a Barwell™ preformer and slugs of the desired weight are produced. The slugs are pre-formed using a three-plate multicavity mold assembly, wherein the slugs are placed in the bottom hemispherical cavities of the desired diameter. A middle forming plate, having hemispherical "buttons" on the top and bottom of this plate is placed on top of the slugs in the bottom cavities. A second set of slugs is placed on the top "buttons" of the forming plate. The mold is closed under heat and pressure to form the hollow half cores. The temperature is sufficient to allow the stock to flow and fill the cavities but not hot enough to fully cross-link the rubber cores. Cold water is applied to the mold to chill the rubber half cores to make them rigid. The mold is opened and the middle plate is removed, leaving hollow hemispherical uncured outer core stock in the top and bottom cavities.

An elastomeric "pill" containing blowing agent of the appropriate size and weight is placed in the center of the bottom hollow core stock. The mold is closed under heat and pressure that is sufficient to decompose the blowing agent and cross-link the cellular nucleus and the outer core stock together. Cold water is applied to the mold and the dual cores are removed. The above "pill" may also be encased with a barrier resin or film to resist the permeation of the nascent gas pressure from the nucleus.

Alternatively, the hemispherical hollow cores may be formed and cross-liked separately and joined together with uncured rubber adhesive with the pill inside. The assembly is reheated under pressure to activate the blowing agent and cross-link the core and adhesive. This method will insure a hollow concentric spherical inner core that will not collapse under the pressure of molding.

The center is converted into a dual core by providing at least one layer of core material thereon, as described above. For example, a layer of core material ranging in thickness from about 0.69 to about 0.38 inches and preferably from about 0.65 to about 0.60 inches produces an effective core layer. The outer core layers may be of similar or different matrix material as the spherical center. Preferably the outer core layer comprises polybutadiene. In some instances the polybutadiene is weight adjusted to compensate for the light-weight spherical center.

After molding, the core comprising a centrally located center surrounded by at least one outer core layer is removed from the mold and the surface thereof preferably is treated to facilitate adhesion thereof to the covering materials. Surface treatment can be effected by any of the several techniques known in the art, such as corona discharge, ozone treatment, sand blasting, brush tumbling, chemicals and the like. Preferably, surface treatment is effected by grinding with an abrasive wheel.

As previously noted, the center core component is preferably of a foamed structure. And, as previously noted, one or more blowing agents are incorporated into the composition of the center core component. Preferably, the blowing agent is activated prior to cross-linking of the composition and while the composition is flowable. Upon activation of the blowing agent, an amount of gas is generated, such as nitrogen. The resulting increase in volume from conversion of the agent, previously in a solid or liquid state, to a gaseous state causes a plurality of gas-filled cells or interior voids within the polymeric matrix to form. After formation of the cells, the polymer matrix is cross-linked. In the event that activation of the blowing agent occurs by heating and cross-linking by heating, it may be preferred to select a blowing agent having an activation temperature that is lower than the temperature at which cross-linking occurs. This practice will promote the formation of cells that are closed. In the event that it is desired to form an open-celled configuration, it would generally be preferred to solidify and cross-link the polymer matrix of the center core component first and then activate the blowing agent. However, the formation of cells that are either open or closed depends upon other factors, as previously described.

An important feature of the present invention is that the center core component is pressurized. As previously noted, this means that the entrapped gas within cells in the center component is at a pressure greater than atmospheric pressure. The activation of the blowing agent preferably occurs when the center core component is encapsulated within one or more core layers. This minimizes the amount of gas from activation of the blowing agent that escapes from the core. By retaining the gas within the center core component, the pressurized aspect of the center core is promoted.

An indication as to the degree or extent of pressurization of the center core component is the increase in volume exhibited by the center core component when surrounding core layers are removed. Generally, center core components as described herein, increase in size from about 10% to about 100% or more of their original diameter. It will be appreciated that such increase in volume is merely an indication of the relatively high internal pressure of the center core when constrained by a core layer. However, it is contemplated that the pressure of gas within a center core component, encapsulated within one or more core layers as described herein, is generally greater than atmospheric pressure and may be as high as 100 psi or more.

In yet another aspect of the present invention, it is preferred that the cross-linking operation, i.e. heating operation, performed upon the center core component is performed after at least one core layer has been formed about the center core component. It has been found that cross-linking occurs along the interface between the center core component and the core layer immediately adjacent to the center core component. The resulting cross-linking further promotes retention of the gas generated within the center core component upon activation of the blowing agent. Further sealing of the center core component, i.e. retention of gas within the center core component, is provided by the one or more core layers disposed about the center core component.

It has also been found that, in some instances, the molded cores and finished balls lose internal pressure over time as the gas dissipates through the core and cover into the atmosphere. This can be reduced or eliminated by the following methods:

The finished golf balls may be packaged in metal or plastic containers that are pressurized with the same pressure and gas that is contained in the nucleus of the golf balls. This would be similar to the packaging of tennis balls and hand balls.

Additionally, a barrier layer or film of polymer such as that shown in FIGS. 3 and 4 can be employed to reduce or eliminate the diffusion of the internal gas and pressure. This layer, or multiple layers thereof, may also be formed under the outside dimpled cover or in between any of the core and/or cover layers.

The preferred gas is nitrogen as it permeates less than carbon dioxide or oxygen. See for example the tables below showing the permeability of different gases in various polymers set forth in the Polymer Handbook, 3rd Edition, incorporated herein by reference.

Permeability of Gases in Polymers (source = Polymer Handbook, 3rd Edition)
*units of permeability are 10–13 $cm^3$(@STP)cm/($cm^2$s Pa) 0.004497

| Polymer | Gas | Permeability* |
|---|---|---|
| Low Density Polyethylene | $SF_6$ | 0.1300000 |
| High Density Polyethylene | $SF_6$ | 0.0063000 |
| EP (40/60) rubber (amorphous) | | |
| Polypropylene (50% crystalline) | | |
| Polystyrene (biaxially oriented) | | |
| Polyacrylonitrile | | |
| BAREX (acyrlonitrile-co-methyl acrylate) | | |
| SAN (86/14 A/S) | | |
| Poly(methacrylonitrile) | | |
| Poly(vinyl alcohol) 0% RH | | |

-continued

Permeability of Gases in Polymers (source = Polymer Handbook, 3rd Edition)
*units of permeability are 10–13 $cm^3$(@STP)cm/($cm^2$s Pa) 0.004497

| Polymer | Gas | Permeability* |
|---|---|---|
| Poly(vinyl alcohol) 100% RH | | |
| Poly(vinyl chloride) unplasticized | | |
| Poly(vinylidene chloride) - SARAN | | |
| Poly(tetrafluoroethylene) | | |
| Poly(trifluorochloroethylene) - KEL F (80% crystalline) | | |
| Poly(vinyl fluoride) - TEDLAR | | |
| Poly(butadiene) | | |
| Poly(butadiene-co-styrene) - HYCAR (80/20 B/S) | | |
| Poly(chloroprene) - NEOPRENE | | |
| Poly(isobutene-co-isoprene) - BUTYL | | |
| trans-Polyisoprene -xlinked gutta percha | | |
| Poly(oxy-2,6-dimethyl-1,4-phenylene) - PPO | | |
| Polycarbonate - LEXAN | $SF_6$ | 0.0000049 |
| Poly(ethylene terephthalate) - amorphous | | |
| Poly(ethylene terephthalate) -40% crystalline | | |
| NYLON 6 | | |
| NYLON 66 | | |
| Cellulose hydrate - CELLOPHANE (0% RH) | | |
| Cellulose hydrate - CELLOPHANE (100% RH) | | |
| Low Density Polyethylene | $N_2$ | 0.7300 |
| High Density Polyethylene | $N_2$ | 0.1100 |
| EP (40/60) rubber (amorphous) | $N_2$ | 3.7000 |
| Polypropylene (50% crystalline) | $N_2$ | 0.3300 |
| Polystyrene (biaxially oriented) | $N_2$ | 0.5900 |
| Polyacrylonitrile | $N_2$ | |
| BAREX (acyrlonitrile-co-methyl acrylate) | $N_2$ | 0.0009 |
| SAN (86/14 A/S) | $N_2$ | |
| Poly(methacrylonitrile) | $N_2$ | |
| Poly(vinyl alcohol) 0% RH | $N_2$ | 0.0001 |
| Poly(vinyl alcohol) 100% RH | $N_2$ | 0.2480 |
| Poly(vinyl chloride) unplasticized | $N_2$ | 0.0089 |
| Poly(vinylidene chloride) - SARAN | $N_2$ | 0.0007 |
| Poly(tetrafluoroethylene) | $N_2$ | 1.0000 |
| Poly(trifluorochloroethylene) -KEL F (80% crystalline) | $N_2$ | 0.0035 |
| Poly(vinyl fluoride) TEDLAR | $N_2$ | 0.0012 |
| Poly(butadiene) | $N_2$ | 4.8400 |
| Poly(butadiene-co-styrene) - HYCAR (80/20 B/S) | $N_2$ | 1.2800 |
| Poly(chloroprene) - NEOPRENE | $N_2$ | 0.8800 |
| Poly(isobutene-co-isoprene) - BUTYL | $N_2$ | 0.2430 |
| trans-Polyisoprene -xlinked gutta percha | $N_2$ | 1.6200 |
| Poly(oxy-2,6-dimethyl-1,4-phenylene) - PPO | $N_2$ | 2.8600 |
| Polycarbonate - LEXAN ® | $N_2$ | 0.2250 |
| Poly(ethylene terephthalate) - amorphous | $N_2$ | 0.0108 |
| Poly(ethylene terephthalate) - 40% crystalline | $N_2$ | 0.0051 |
| NYLON 6 | $N_2$ | 0.0071 |
| NYLON 66 | $N_2$ | |
| Cellulose hydrate - CELLOPHANE (0% RH) | $N_2$ | 0.0024 |
| Cellulose hydrate - CELLOPHANE (100% RH) | $N_2$ | 0.0138 |
| Low Density Polyethylene | $O_2$ | 2.2000 |
| High Density Polyethylene | $O_2$ | 0.3000 |
| EP (40/60) rubber (amorphous) | $O_2$ | |
| Polypropylene (50% crystalline) | $O_2$ | 1.4800 |
| Polystyrene (biaxially oriented) | $O_2$ | 2.0000 |
| Polyacrylonitrile | $O_2$ | 0.0002 |
| BAREX (acyrlonitrile-co-methyl acrylate) | $O_2$ | 0.0036 |
| SAN (86/14 A/S) | $O_2$ | 0.0032 |
| Poly(methacrylonitrile) | $O_2$ | 0.0009 |
| Poly(vinyl alcohol) 0% RH | $O_2$ | 0.0067 |
| Poly(vinyl alcohol) 100% RH | $O_2$ | |
| Poly(vinyl chloride) unplasticized | $O_2$ | 0.0340 |
| Poly(vinylidene chloride) - SARAN | $O_2$ | 0.0038 |
| Poly(tetrafluoroethylene) | $O_2$ | 3.2000 |
| Poly(trifluorochloroethylene) -KEL F (80% crystalline) | $O_2$ | 0.3000 |
| Poly(vinyl fluoride) - TEDLAR | $O_2$ | 0.0139 |
| Poly(butadiene) | $O_2$ | 14.3000 |
| Poly(butadiene-co-styrene) - HYCAR (80/20 B/S) | $O_2$ | |
| Poly(chloroprene) - NEOPRENE | $O_2$ | 2.9600 |
| Poly(isobutene-co-isoprene) - BUTYL | $O_2$ | 0.9770 |
| trans-Polyisoprene -xlinked gutta percha | $O_2$ | 0.7000 |
| Poly(oxy-2,6-dimethyl-1,4-phenylene) - PPO | $O_2$ | 11.9000 |
| Polycarbonate - LEXAN | $O_2$ | 1.0500 |
| Poly(ethylene terephthalate) - amorphous | $O_2$ | 0.0444 |

-continued

Permeability of Gases in Polymers (source = Polymer Handbook, 3rd Edition)
*units of permeability are 10–13 $cm^3$(@STP)cm/($cm^2$s Pa) 0.004497

| Polymer | Gas | Permeability* |
|---|---|---|
| Poly(ethylene terephthalate) - 40% crystalline | $O_2$ | 0.0257 |
| NYLON 6 | $O_2$ | 0.0285 |
| NYLON 66 | $O_2$ | |
| Cellulose hydrate - CELLOPHANE (0% RH) | $O_2$ | 0.0016 |
| Cellulose hydrate - CELLOPHANE (100% RH) | $O_2$ | 0.0087 |
| Low Density Polyethylene | $CO_2$ | 9.5000 |
| High Density Polyethylene | $CO_2$ | 0.2700 |
| EP (40/60) rubber (amorphous) | $CO_2$ | |
| Polypropylene (50% crystalline) | $CO_2$ | 4.6400 |
| Polystyrene (biaxially oriented) | $CO_2$ | 7.9000 |
| Polyacrylonitrile | $CO_2$ | 0.0006 |
| BAREX (acyrlonitrile-co-methyl acrylate) | $CO_2$ | 0.0054 |
| SAN (86/14 A/S) | $CO_2$ | 0.0110 |
| Poly(methacrylonitrile) | $CO_2$ | 0.0024 |
| Poly(vinyl alcohol) 0% RH | $CO_2$ | 0.0092 |
| Poly(vinyl alcohol) 100% RH | $CO_2$ | 65.0000 |
| Poly(vinyl chloride) unplasticized | $CO_2$ | 0.1200 |
| Poly(vinylidene chloride) - SARAN | $CO_2$ | 0.2180 |
| Poly(tetrafluoroethylene) | $CO_2$ | 7.5000 |
| Poly(trifluorochloroethylene) - KEL F (80% crystalline) | $CO_2$ | 0.1580 |
| Poly(vinyl fluoride) - TEDLAR | $CO_2$ | 0.0690 |
| Poly(butadiene) | $CO_2$ | 104.0000 |
| Poly(butadiene-co-styrene) - HYCAR (80/20 B/S) | $CO_2$ | |
| Poly(chloroprene) - NEOPRENE | $CO_2$ | 19.2000 |
| Poly(isobutene-co-isoprene) - BUTYL | $CO_2$ | 3.8900 |
| trans-Polyisoprene - xlinked gutta percha | $CO_2$ | 26.7000 |
| Poly(oxy-2,6-dimethyl-1,4-phenylene) - PPO | $CO_2$ | 56.8000 |
| Polycarbonate - LEXAN | $CO_2$ | 6.0000 |
| Poly(ethylene terephthalate) - amorphous | $CO_2$ | 0.2270 |
| Poly(ethylene terephthalate) - 40% crystalline | $CO_2$ | 0.1180 |
| NYLON 6 | $CO_2$ | 0.0660 |
| NYLON 66 | $CO_2$ | 0.0520 |
| Cellulose hydrate - CELLOPHANE (0% RH) | $CO_2$ | 0.0035 |
| Cellulose hydrate - CELLOPHANE (100% RH) | $CO_2$ | 0.1920 |

The preferred polymers for the barrier layer are the types that have the lowest permeability such as poly (vinylidene chloride) (Saran), Barex resin (acyrlonitrile-co-methyl acrylate, poly (vinyl alcohol) @ 0% RH, and (PET) poly (ethylene terephthalate)-40% crystalline.

Another method is to replace the Natsyn™ 2200 in the nucleus formulation with halobutyl rubber. An example of such halobutyl rubber is Bromobutyl™ 2030 from Bayer Corp.

Cover Layer(s)

The cover comprises at least one layer. For a multi-layer cover, the cover comprises at least two layers, and it may comprise any number of layers desired, such as two, three, four, five, six and the like. A two piece cover comprises a first or inner layer or ply (also referred to as a mantle layer) and a second or outer layer or ply. The inner layer can be ionomer, ionomer blends, non-ionomer, non-ionomer blends, or blends of ionomer and non-ionomer. The outer layer can be ionomer, ionomer blends, non-ionomer, non-ionomer blends, or blends of ionomer and non-ionomer, and may be of the same or different material as the inner cover layer. For multi-layer covers having three or more layers, each layer can be ionomer, non-ionomer, or blends thereof, and the layers may be of the same or different materials.

In a preferred embodiment of a golf ball, the inner layer or single cover layer is comprised of a high acid (i.e. greater than 16 weight percent acid) ionomer resin or high acid ionomer blend. More preferably, the inner layer is comprised of a blend of two or more high acid (i.e. greater than 16 weight percent acid) ionomer resins neutralized to various extents by different metal cations. The inner cover layer may or may not include a metal stearate (e.g., zinc stearate) or other metal fatty acid salt. The purpose of the metal stearate or other metal fatty acid salt is to lower the cost of production without affecting the overall performance of the finished golf ball.

In a further embodiment, the inner layer or single cover layer is comprised of a low acid (i.e. 16 weight percent acid or less) ionomer resin or low acid ionomer blend. Preferably, the inner layer or single layer is comprised of a blend of two or more low acid (i.e. 16 weight percent acid or less) ionomer resins neutralized to various extents by different metal cations. As with the high acid inner cover layer embodied, the inner cover layer may or may not include a metal stearate (e.g., zinc stearate) or other metal fatty acid salt.

In golf balls having a multi-layer cover, it has been found that a hard inner layer(s) provides for a substantial increase in resilience (i.e., enhanced distance) over known multi-layer covered balls. A softer outer layer (or layers) provides for desirable "feel" and high spin rate while maintaining respectable resiliency. The soft outer layer allows the cover to deform more during impact and increases the area of contact between the club face and the cover, thereby imparting more spin on the ball. As a result, the soft cover provides the ball with a balata-like feel and playability characteristics with improved distance and durability. Consequently, the overall combination of the inner and outer cover layers results in a golf ball having enhanced resilience (improved travel distance) and durability (i.e. cut resistance, etc.)

characteristics while maintaining and in many instances, improving, the playability properties of the ball.

The combination of a hard inner cover layer with a soft outer cover layer provides for excellent overall coefficient of restitution (for example, excellent resilience) because of the improved resiliency produced by the inner cover layer. While some improvement in resiliency is also produced by the outer cover layer, the outer cover layer generally provides for a more desirable feel and high spin, particularly at lower swing speeds with highly lofted clubs such as half wedge shots.

In one preferred embodiment, the inner cover layer may be harder than the outer cover layer and generally has a thickness in the range of 0.0005 to 0.15 inches, preferably 0.001–0.10 inches for a 1.68 inch ball, and sometimes slightly thicker for a 1.72 inch (or more) ball. The dual core and inner cover layer (if applicable) together preferably form an inner ball having a coefficient of restitution of 0.780 or more and more preferably 0.790 or more, and a diameter in the range of 1.48–1.66 inches for a 1.68 inch ball and 1.50–1.70 inches for a 1.72 inch (or more) ball.

The inner cover layer preferably has a Shore D hardness of 60 or more (or at least 90 Shore C). It is particularly advantageous if the golf balls of the invention have an inner layer with a Shore D hardness of 65 or more (or at least 100 Shore C). These measurements are made in general accordance to ASTM 2240 except that they are made on the ball itself and not on a plaque. If the inner layer is too soft or thin, it is sometimes difficult to measure the Shore D of the inner layer as the layer may puncture during measurement. In such circumstances, an alternative Shore C measurement should be utilized. Additionally, if the core (or inner layer) is harder than the layer being measured, this will sometimes influence the reading. Moreover, if the Shore C or Shore D is measured on a plaque of material, different values than those measured on the ball will result. Consequently, when a Shore hardness measurement is referenced to herein, it is based on a measurement made on the ball, except if specific reference is made to plaque measurements.

The above-described characteristics of the inner cover layer provide an inner ball having a PGA compression of 100 or less. It is found that when the inner ball has a PGA compression of 90 or less, excellent playability results.

The inner layer compositions of the embodiments described herein may include the high acid ionomers such as those developed by E. I. DuPont de Nemours & Company under the trademark Surlyn® and by Exxon Corporation under the trademarks Escor® or Iotek®, or blends thereof. Examples of compositions which may be used as the inner layer herein are set forth in detail in U.S. Pat. No. 5,688,869, which is incorporated herein by reference. Of course, the inner layer high acid ionomer compositions are not limited in any way to those compositions set forth in said patent. Those compositions are incorporated herein by way of examples only.

The high acid ionomers which may be suitable for use in formulating the inner layer compositions are ionic copolymers which are the metal (such as sodium, zinc, magnesium, etc.) salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (for example, iso- or n-butylacrylate, etc.) can also be included to produce a softer terpolymer. The carboxylic acid groups of the copolymer are partially neutralized (for example, approximately 10–100%, preferably 30–70%) by the metal ions. Each of the high acid ionomer resins which may be included in the inner layer cover compositions of the invention contains greater than 16% by weight of a carboxylic acid, preferably from about 17% to about 25% by weight of a carboxylic acid, more preferably from about 18.5% to about 21.5% by weight of a carboxylic acid.

The high acid ionomeric resins available from Exxon under the designation Escor® or Iotek®, are somewhat similar to the high acid ionomeric resins available under the Surlyn® trademark. However, since the Escor®/Iotek® ionomeric resins are sodium, zinc, etc. salts of poly (ethylene-acrylic acid) and the Surlyn® resins are zinc, sodium, magnesium, etc. salts of poly(ethylene-methacrylic acid), distinct differences in properties exist.

Examples of the high acid methacrylic acid based ionomers found suitable for use in accordance with this invention include, but are not limited to, Surlyn® 8220 and 8240 (both formerly known as forms of Surlyne AD-8422), Surlyn® 9220 (zinc cation), Surlyn® SEP-503-1 (zinc cation), and Surlyn® SEP-503-2 (magnesium cation). According to DuPont, all of these ionomers contain from about 18.5 to about 21.5% by weight methacrylic acid.

Examples of the high acid acrylic acid based ionomers suitable for use in the present invention also include, but are not limited to, the Escor® or Iotek® high acid ethylene acrylic acid ionomers produced by Exxon such as Ex 1001, 1002, 959, 960, 989, 990, 1003, 1004, 993, and 994. In this regard, Escor® or Iotek® 959 is a sodium ion neutralized ethylene-acrylic neutralized ethylene-acrylic acid copolymer. According to Exxon, Ioteks® 959 and 960 contain from about 19.0 to about 21.0% by weight acrylic acid with approximately 30 to about 70 percent of the acid groups neutralized with sodium and zinc ions, respectively.

Furthermore, as a result of the previous development by the assignee of this application of a number of high acid ionomers neutralized to various extents by several different types of metal cations, such as by manganese, lithium, potassium, calcium and nickel cations, several high acid ionomers and/or high acid ionomer blends besides sodium, zinc and magnesium high acid ionomers or ionomer blends are also available for golf ball cover production. It has been found that these additional cation neutralized high acid ionomer blends produce inner cover layer compositions exhibiting enhanced hardness and resilience due to synergies which occur during processing. Consequently, the metal cation neutralized high acid ionomer resins recently produced can be blended to produce substantially higher C.O.R.'s than those produced by the low acid ionomer inner cover compositions presently commercially available.

More particularly, several metal cation neutralized high acid ionomer resins have been produced by the assignee of this invention by neutralizing, to various extents, high acid copolymers of an alpha-olefin and an alpha, beta-unsaturated carboxylic acid with a wide variety of different metal cation salts. This discovery is the subject matter of U.S. application Ser. No. 08/493,089, now U.S. Pat. No. 5,688,869, incorporated herein by reference. It has been found that numerous metal cation neutralized high acid ionomer resins can be obtained by reacting a high acid copolymer (i.e. a copolymer containing greater than 16% by weight acid, preferably from about 17 to about 25 weight percent acid, and more preferably about 20 weight percent acid), with a metal cation salt capable of ionizing or neutralizing the copolymer to the extent desired (for example, from about 10% to 90%).

The base copolymer is made up of greater than 16% by weight of an alpha, beta-unsaturated carboxylic acid and an alpha-olefin. Optionally, a softening comonomer can be included in the copolymer. Generally, the alpha-olefin has from 2 to 10 carbon atoms and is preferably ethylene, and the unsaturated carboxylic acid is a carboxylic acid having from about 3 to 8 carbons. Examples of such acids include acrylic acid, methacrylic acid, ethacrylic acid, chloroacrylic acid, crotonic acid, maleic acid, fumaric acid, and itaconic acid, with acrylic acid being preferred.

The softening comonomer that can be optionally included in the inner cover layer of the golf ball of the invention may be selected from the group consisting of vinyl esters of aliphatic carboxylic acids wherein the acids have 2 to 10 carbon atoms, vinyl ethers wherein the alkyl groups contain 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

Consequently, examples of a number of copolymers suitable for use to produce the high acid ionomers included in the present invention include, but are not limited to, high acid embodiments of an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, etc. The base copolymer broadly contains greater than 16% by weight unsaturated carboxylic acid, from about 39 to about 83% by weight ethylene and from 0 to about 40% by weight of a softening comonomer. Preferably, the copolymer contains about 20% by weight unsaturated carboxylic acid and about 80% by weight ethylene. Most preferably, the copolymer contains about 20% acrylic acid with the remainder being ethylene.

Along these lines, examples of the preferred high acid base copolymers which fulfill the criteria set forth above are a series of ethylene-acrylic copolymers which are commercially available from The Dow Chemical Company, Midland, Mich., under the Primacor® designation.

The metal cation salts utilized in the invention are those salts which provide the metal cations capable of neutralizing, to various extents, the carboxylic acid groups of the high acid copolymer. These include acetate, oxide or hydroxide salts of lithium, calcium, zinc, sodium, potassium, nickel, magnesium, and manganese.

Examples of such lithium ion sources are lithium hydroxide monohydrate, lithium hydroxide, lithium oxide and lithium acetate. Sources for the calcium ion include calcium hydroxide, calcium acetate and calcium oxide. Suitable zinc ion sources are zinc acetate dihydrate and zinc acetate, a blend of zinc oxide and acetic acid. Examples of sodium ion sources are sodium hydroxide and sodium acetate. Sources for the potassium ion include potassium hydroxide and potassium acetate. Suitable nickel ion sources are nickel acetate, nickel oxide and nickel hydroxide. Sources of magnesium include magnesium oxide, magnesium hydroxide, and magnesium acetate. Sources of manganese include manganese acetate and manganese oxide.

The metal cation neutralized high acid ionomer resins are produced by reacting the high acid base copolymer with various amounts of the metal cation salts above the crystalline melting point of the copolymer, such as at a temperature from about 200° F. to about 500° F., preferably from about 250° F. to about 350° F. under high shear conditions at a pressure of from about 10 psi to 10,000 psi. Other well known blending techniques may also be used. The amount of metal cation salt utilized to produce the new metal cation neutralized high acid based ionomer resins is the quantity which provides a sufficient amount of the metal cations to neutralize the desired percentage of the carboxylic acid groups in the high acid copolymer. The extent of neutralization is generally from about 10% to about 90%.

A number of different types of metal cation neutralized high acid ionomers can be obtained from the above indicated process. These include high acid ionomer resins neutralized to various extents with manganese, lithium, potassium, calcium and nickel cations. In addition, when a high acid ethylene/acrylic acid copolymer is utilized as the base copolymer component of the invention and this component is subsequently neutralized to various extents with the metal cation salts producing acrylic acid based high acid ionomer resins neutralized with cations such as sodium, potassium, lithium, zinc, magnesium, manganese, calcium and nickel, several cation neutralized acrylic acid based high acid ionomer resins are produced.

When compared to low acid versions of similar cation neutralized ionomer resins, the metal cation neutralized high acid ionomer resins exhibit enhanced hardness, modulus and resilience characteristics. These are properties that are particularly desirable in a number of thermoplastic fields, including the field of golf ball manufacturing.

The low acid ionomers which may be suitable for use in formulating the inner layer compositions of the subject invention are ionic copolymers which are the metal (sodium, zinc, magnesium, etc.) salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (for example, iso- or n-butylacrylate, etc.) can also be included to produce a softer terpolymer. The carboxylic acid groups of the copolymer are partially neutralized (for example, approximately 10 to 100%, preferably 30 to 70%) by the metal ions. Each of the low acid ionomer resins which may be included in the inner layer cover compositions of the invention contains 16% by weight or less of a carboxylic acid.

The inner layer compositions may include the low acid ionomers such as those developed and sold by E. I. DuPont de Nemours & Company under the trademark Surlyn® and by Exxon Corporation under the trademarks Escor® or Iotek®, ionomers made in-situ, or blends thereof.

In one embodiment of the inner cover layer, a blend of high and low acid ionomer resins is used. These can be the ionomer resins described above, combined in a weight ratio which preferably is within the range of 10 to 90 to 90 to 10 percent high and low acid ionomer resins.

Another embodiment of the inner cover layer is a cover comprising a non-ionomeric thermoplastic material or thermoset material. Suitable non-ionomeric materials include, but are not limited to, metallocene catalyzed polyolefins or polyamides, polyamide/ionomer blends, polyphenylene ether/ionomer blends, etc., which have a Shore D hardness of at least 60 (or a Shore C hardness of at least about 90) and a flex modulus of greater than about 30,000 psi, preferably greater than about 50,000 psi, or other hardness and flex modulus values which are comparable to the properties of the ionomers described above. Other suitable materials include but are not limited to, thermoplastic or thermosetting polyurethanes, thermoplastic block polyesters, for example, a polyester elastomer such as that marketed by DuPont under the trademark Hytrel®, or thermoplastic block polyamides, for example, a polyether amide such as that marketed by Elf Atochem S. A. under the trademark Pebax®, a blend of two or more non-ionomeric thermoplastic elastomers, or a blend of one or more ionomers and one or more non-ionomeric thermoplastic elastomers. These materials can be blended with the ionomers described above in order to reduce cost relative to the use of higher quantities of ionomer.

Additional materials suitable for use in the inner cover layer or single cover layer of the present invention include polyurethanes. These are described in more detail below.

Any number of inner layers may be used. Each layer may be the same or different material as any other layer, and each may be of the same or different thickness. One or more of the inner layers, if applicable, may also be the same as the outer cover layer.

A core with a hard inner cover layer formed thereon generally provides the multi-layer golf ball with resilience and distance. In one preferred embodiment, the outer cover layer is comparatively softer than the inner cover layer. For a golf ball having a single cover layer and a core, the cover layer may be a soft cover layer, as described herein. The softness provides for the feel and playability characteristics typically associated with balata or balata-blend balls.

The soft outer cover layer or ply is comprised of a relatively soft, low flex modulus (preferably about 1,000 psi to about 20,000 psi, more preferably about 5,000 psi to about 20,000) material or blend of materials. The outer cover layer (or single cover layer, if applicable) comprises ionomers, non-ionomers, blends of ionomers, blends of non-ionomers and blends of ionomers and non-ionomers. Preferably, the outer cover layer comprises a polyurethane, a polyurea, a blend of two or more polyurethanes/polyureas, or a blend of one or more ionomers or one or more non-ionomeric thermoplastic materials with a polyurethane/polyurea, preferably a thermoplastic polyurethane or reaction injection molded polyurethane/polyurea (described in more detail below). The outer layer is 0.0005 to about 0.15 inches in thickness, preferably about 0.001 to about 0.10 inches in thickness, and sometimes slightly thicker for a 1.72 inch (or more) ball, but thick enough to achieve desired playability characteristics while minimizing expense. Thickness is defined as the average thickness of the non-dimpled areas of the outer cover layer. The outer cover layer preferably has a Shore D hardness of 60 or less (or less than 90 Shore C), and more preferably 55 or less (or about 80 Shore C or less).

In another preferred embodiment, the outer cover layer is comparatively harder than the inner cover layer. The outer layer is comprised of a relatively hard, higher flex modulus (about 30,000 psi or greater) material or blend of materials. The inner cover layer(s) may be a softer material such as a polyurethane or other non-ionomer, or a blend of materials, and the outer layer may be a harder material such as a harder ionomer, non-ionomer, or blend of materials.

The outer cover layer of the invention is formed over a core (and inner cover layer or layers if a multi-layer cover) to result in a golf ball having a coefficient of restitution of at least 0.770, more preferably at least 0.780, and most preferably at least 0.790. The coefficient of restitution of the ball will depend upon the properties of both the core and the cover. The PGA compression of the golf ball is 100 or less, and preferably is 90 or less.

In one preferred embodiment, the outer cover layer comprises a polyurethane, a polyurea or a blend of polyurethanes/polyureas. Polyurethanes are polymers which are used to form a broad range of products. They are generally formed by mixing two primary ingredients during processing. For the most commonly used polyurethanes, the two primary ingredients are a polyisocyanate (for example, diphenylmethane diisocyanate monomer ("MDI") and toluene diisocyanate ("TDI") and their derivatives) and a polyol (for example, a polyester polyol or a polyether polyol).

A wide range of combinations of polyisocyanates and polyols, as well as other ingredients, are available. Furthermore, the end-use properties of polyurethanes can be controlled by the type of polyurethane utilized, such as whether the material is thermoset (cross-linked molecular structure not flowable with heat) or thermoplastic (linear molecular structure flowable with heat).

Cross-linking occurs between the isocyanate groups (-NCO) and the polyol's hydroxyl end-groups (-OH). Additionally, the end-use characteristics of polyurethanes can also be controlled by different types of reactive chemicals and processing parameters. For example, catalysts are utilized to control polymerization rates. Depending upon the processing method, reaction rates can be very quick (as in the case for some reaction injection molding systems ("RIM")) or may be on the order of several hours or longer (as in several coating systems such as a cast system). Consequently, a great variety of polyurethanes are suitable for different end-uses.

Polyurethanes are typically classified as thermosetting or thermoplastic. A polyurethane becomes irreversibly "set" when a polyure-thane prepolymer is cross-linked with a polyfunctional curing agent, such as a polyamine or a polyol. The prepolymer typically is made from polyether or polyester. A prepolymer is typically an isocyanate terminated polymer that is produced by reacting an isocyanate with a moiety that has active hydrogen groups, such as a polyester and/or polyether polyol. The reactive moiety is a hydroxyl group. Diisocyanate polyethers are preferred because of their water resistance.

The physical properties of thermoset polyurethanes are controlled substantially by the degree of cross-linking and by the hard and soft segment content. Tightly cross-linked polyurethanes are fairly rigid and strong. A lower amount of cross-linking results in materials that are flexible and resilient. Thermoplastic polyurethanes have some cross-linking, but primarily by physical means. The cross-linked bonds can be reversibly broken by increasing temperature, such as during molding or extrusion. In this regard, thermoplastic polyurethanes can be injection molded, and extruded as sheet and blown film. They can be used up to about 350° F. and are available in a wide range of hardnesses.

Polyurethane materials suitable for the present invention are formed by the reaction of a polyisocyanate, a polyol, and optionally one or more chain extenders. The polyol component includes any suitable polyether or polyesterpolyol. Additionally, in an alternative embodiment, the polyol component is polybutadiene diol. The chain extenders include, but are not limited, to diols, triols and amine extenders. Any suitable polyisocyanate may be used to form a polyurethane according to the present invention. The poly-isocyanate is preferably selected from the group of diisocyanates including, but not limited, to 4,4'-diphenylmethane diisocyanate ("MDI"); 2,4-toluene diisocyanate ("TDI"); m-xylylene diisocyanate ("XDI"); methylene bis-(4-cyclohexyl isocyanate) ("HMDI"); hexamethylene diisocyanate (HDI); naphtha-lene -1,5,-diisocyanate ("NDI"); 3,3'-dimethyl-4,4'-biphenyl diisocyanate ("TODI"); 1,4-diisocyanate benzene ("PPDI"); phenylene-1,4-diisocyanate; and 2,2,4- or 2,4,4-trimethyl hexamethylene diisocyanate ("TMDI").

Other less preferred diisocyanates include, but are not limited to, isophorone diisocyanate ("IPDI"); 1,4-cyclohexyl diisocyanate ("CHDI"); diphe-nylether-4,4'-diisocyanate; p,p'-diphenyl diisocyanate; lysine diisocyanate ("LDI"); 1,3-bis(isocyanato methyl)cyclohexane; and polymethylene polyphenyl isocyanate ("PMDI").

One polyurethane component which can be used in the present invention incorporates TMXDI ("META") aliphatic isocyanate. Polyurethanes based on meta-tetramethylxylylene diisocyanate (TMXDI) can provide improved gloss retention UV light stability, thermal stability, and hydrolytic stability. Additionally, TMXDI ("META") aliphatic isocyanate has demonstrated favorable toxicological properties. Furthermore, because it has a low viscosity, it is usable with a wider range of diols (to polyurethane) and diamines (to polyureas). If TMXDI is used, it typically, but not necessarily, is added as a direct replacement for some or all of the other aliphatic isocyanates in accordance with the suggestions of the supplier. Because of slow reactivity of TMXDI, it may be useful or necessary to use catalysts to have practical demolding times. Hardness, tensile strength and elongation can be adjusted by adding further materials in accordance with the supplier's instructions.

The polyurethane which is selected for use as a golf ball cover preferably has a Shore D hardness (plaque) of from about 10 to about 55 (Shore C of about 15 to about 75), more preferably from about 25 to about 55 (Shore C of about 40 to about 75), and most preferably from about 30 to about 55 (Shore C of about 45 to about 75) for a soft cover layer.

The polyurethane which is to be used for a cover layer preferably has a flex modulus from about 1 to about 310 Kpsi, more preferably from about 3 to about 100 Kpsi, and most preferably from about 3 to about 20 Kpsi for a soft cover layer and 30 to 70 Kpsi for a hard cover layer. Non-limiting examples of polyurethanes suitable for use in the outer cover layer include a thermoplastic polyester polyurethane such as Bayer Corporation's Texin® polyester polyurethane (such as Texin® DP7-1097 and Texin® 285 grades) and a polyester polyurethane such as B.F. Goodrich Company's Estane® polyester polyurethane (such as Estane® X-4517 grade). The thermoplastic polyurethane material may be blended with a soft ionomer or other non-ionomer. For example, polyamides blend well with soft ionomer.

Other soft, relatively low modulus non-ionomeric thermoplastic or thermoset polyurethanes may also be utilized to produce the outer cover layers, or any of the inner cover layers, as long as the non-ionomeric materials produce the playability and durability characteristics desired. These include, but are not limited to thermoplastic polyurethanes such as the Pellethane® thermoplastic polyurethanes from Dow Chemical Co.; and non-ionomeric thermoset polyurethanes including but not limited to those disclosed in U.S. Pat. No. 5,334,673.

Typically, there are two classes of thermoplastic polyurethane materials: aliphatic polyurethanes and aromatic polyurethanes. The aliphatic materials are produced from a polyol or polyols and aliphatic isocyanates, such as $H_{12}$MDI or HDI, and the aromatic materials are produced from a polyol or polyols and aromatic isocyanates, such as MDI or TDI. The thermoplastic polyurethanes may also be produced from a blend of both aliphatic and aromatic materials, such as a blend of HDI and TDI with a polyol or polyols.

Generally, the aliphatic thermoplastic polyurethanes are lightfast, meaning that they do not yellow appreciably upon exposure to ultraviolet light. Conversely, aromatic thermoplastic polyurethanes tend to yellow upon exposure to ultraviolet light. One method of stopping the yellowing of the aromatic materials is to paint the outer surface of the finished ball with a coating containing a pigment, such as titanium dioxide, so that the ultraviolet light is prevented from reaching the surface of the ball. Another method is to add UV absorbers, optical brighteners and stabilizers to the clear coating(s) on the outer cover, as well as to the thermoplastic polyurethane material itself. By adding UV absorbers and stabilizers to the thermoplastic polyurethane and the coating(s), aromatic polyurethanes can be effectively used in the outer cover layer of golf balls. This is advantageous because aromatic polyurethanes typically have better scuff resistance characteristics than aliphatic polyurethanes, and the aromatic polyurethanes typically cost less than the aliphatic polyurethanes.

Other suitable polyurethane materials for use in the present invention golf balls include reaction injection molded ("RIM") polyurethanes. RIM is a process by which highly reactive liquids are injected into a closed mold, mixed usually by impingement and/or mechanical mixing in an in-line device such as a "peanut mixer," where they polymerize primarily in the mold to form a coherent, one-piece molded article. The RIM process usually involves a rapid reaction between one or more reactive components such as a polyether polyol or polyester polyol, polyamine, or other material with an active hydrogen, and one or more isocyanate-containing constituents, often in the presence of a catalyst. The constituents are stored in separate tanks prior to molding and may be first mixed in a mix head upstream of a mold and then injected into the mold. The liquid streams are metered in the desired weight to weight ratio and fed into an impingement mix head, with mixing occurring under high pressure, for example, 1,500 to 3,000 psi. The liquid streams impinge upon each other in the mixing chamber of the mix head and the mixture is injected into the mold. One of the liquid streams typically contains a catalyst for the reaction. The constituents react rapidly after mixing to gel and form polyurethane polymers. Polyureas, epoxies, and various unsaturated polyesters also can be molded by RIM.

Non-limiting examples of suitable RIM systems for use in the present invention are Bayflex® elastomeric polyurethane RIM systems, Baydur® GS solid polyurethane RIM systems, Prism® solid polyurethane RIM systems, all from Bayer Corp. (Pittsburgh, Pa.), Spectrim® reaction moldable polyurethane and polyurea systems from Dow Chemical USA (Midland, Mich.), including Spectrim® MM 373-A (isocyanate) and 373-B (polyol), and Elastolit® SR systems from BASF (Parsippany, N.J.). Preferred RIM systems include Bayflex® MP-10000, Bayflex® MP-7500 and Bayflex® 110-50, filled and unfilled.

Another preferred embodiment is a golf ball in which at least one of the inner cover layer and/or the outer cover layer comprises a fast-chemical-reaction-produced component. This component comprises at least one material selected from the group consisting of polyurethane, polyurea, polyurethane ionomer, epoxy, and unsaturated polyesters, and preferably comprises polyurethane, polyurea or a blend comprising polyurethanes and/or polymers. A particularly preferred form of the invention is a golf ball with a cover comprising polyurethane or a polyurethane blend.

The polyol component typically contains additives, such as stabilizers, flow modifiers, catalysts, combustion modifiers, blowing agents, fillers, pigments, optical brighteners, and release agents to modify physical characteristics of the cover. Polyurethane/polyurea constituent molecules that were derived from recycled polyurethane can be added in the polyol component.

A golf ball inner cover layer or single cover layer according to the present invention formed from a polyurethane material typically contains from about 0 to about 60 weight percent of filler material, more preferably from about 1 to about 30 weight percent, and most preferably from about 1 to about 20 weight percent.

A golf ball outer cover layer according to the present invention formed from a polyurethane material typically contains from about 0 to about 20 weight percent of filler material, more preferably from about 1 to about 10 weight percent, and most preferably from about 1 to about 5 weight percent.

Moreover, in alternative embodiments, either the inner and/or the outer cover layer (or single cover layer, if applicable) may also additionally comprise up to 100 wt % of a soft, low modulus, non-ionomeric thermoplastic or thermoset material. Non-ionomeric materials are suitable so long as they produce the playability and durability characteristics desired. These include but are not limited to styrene-butadiene-styrene block copolymers, including functionalized styrene-butadiene-styrene block copolymers, styrene-ethylene-butadiene-styrene (SEBS) block copolymers such as Kraton® materials from Shell Chem. Co., and functionalized SEBS block copolymers; metallocene catalyzed polyolefins; ionomer/rubber blends such as those in Spalding U.S. Pat. Nos. 4,986,545; 5,098,105 and 5,187,013; and, Hytrel® polyester elastomers from DuPont and Pebax® polyetheramides from Elf Atochem S. A.

Additional materials may also be added to the inner and outer cover layer of the present invention as long as they do not substantially reduce the playability properties of the ball. Such materials include dyes and/or optical brighteners (for example, Ultramarine Blue™ sold by Whittaker, Clark, and Daniels of South Plainsfield, N.J.) (see U.S. Pat. No. 4,679,795); pigments such as titanium dioxide, zinc oxide, barium sulfate and zinc sulfate; UV absorbers; antioxidants; antistatic agents; and stabilizers. Moreover, the cover compositions of the present invention may also contain softening agents such as those disclosed in U.S. Pat. Nos. 5,312,857 and 5,306,760, including plasticizers, metal stearates, processing acids, and the like, and reinforcing materials such as glass fibers and inorganic fillers, as long as the desired properties produced by the golf ball covers of the invention are not impaired.

Method of Making Golf Ball

In preparing golf balls in accordance with the present invention, a cover layer is molded (preferably by injection molding or by compression molding) about a core (a dual core).

The dual cores of the present invention are preferably formed by the compression molding techniques set forth above. However, it is fully contemplated that liquid injection molding or transfer molding techniques could also be utilized.

A relatively hard inner cover layer is then molded about the resulting dual core component. A comparatively softer outer cover layer is then molded about the inner cover layer. The outer cover diameter is about 1.680 inches. Details of molding the inner and outer covers are set forth herein. Alternatively, a single soft cover can be molded around the dual core.

Most preferably, the resulting golf balls in accordance with the present invention have the following dimensions:

| Size Specifications: | Range | Preferred |
|---|---|---|
| Inner Core | | |
| Max. | 0.830" | 0.344" |
| Min. | 0.200" | 0.340" |
| Outer Core | | |
| Max. | 1.60" | 1.595" |
| Min. | 1.25" | 1.47" |
| Cover Thickness | | |
| Max. | 0.215" | 0.065" |
| Min. | 0.040" | 0.040" |

In a particularly preferred embodiment of the invention, the golf ball has a dimple pattern which provides coverage of 60%–70% or more. The golf ball typically is coated with a durable, abrasion-resistant, relatively non-yellowing finish coat.

The various cover composition layers of the present invention may be produced according to conventional melt blending procedures. Generally, the copolymer resins are blended in a Banbury™ type mixer, two-roll mill, or extruder prior to neutralization. After blending, neutralization then occurs in the melt or molten states in the Banbury™ mixer. Mixing problems are minimal because preferably more than 75 wt %, and more preferably at least 80 wt % of the ionic copolymers in the mixture contain acrylate esters and, in this respect, most of the polymer chains in the mixture are similar to each other. The blended composition is then formed into slabs, pellets, etc., and maintained in such a state until molding is desired.

Alternatively, a simple dry blend of the pelletized or granulated resins which have previously been neutralized to a desired extent and colored masterbatch may be prepared and fed directly into the injection molding machine where homogenization occurs in the mixing section of the barrel prior to injection into the mold. If necessary, further additives such as an inorganic filler, etc., may be added and uniformly mixed before initiation of the molding process. A similar process is utilized to formulate the high acid ionomer resin compositions used to produce the inner cover layer. In one embodiment of the invention, a masterbatch of non-acrylate ester-containing ionomer with pigments and other additives incorporated therein is mixed with the acrylate ester-containing copolymers in a ratio of about 1–7 weight % masterbatch and 93–99 weight % acrylate ester-containing copolymer. However, a masterbatch is generally not used commercially to form the inner cover or mantle layer due to cost concerns.

In compression molding, the inner cover composition is formed via injection at about 380° F. to about 450° F. into smooth surfaced hemispherical shells which are then positioned around the core in a mold having the desired inner cover thickness and subjected to compression molding at 200 to 300° F. for about 2 to 10 minutes, followed by cooling at 50 to 70° F. for about 2 to 7 minutes to fuse the shells together to form a unitary intermediate ball. In addition, the intermediate balls may be produced by injection molding wherein the inner cover layer is injected directly around the core placed at the center of an intermediate ball mold for a period of time in a mold temperature of from 50 to about 100° F. Subsequently, the outer cover layer is molded around the core and the inner layer by similar compression or injection molding techniques to form a dimpled golf ball of a diameter of 1.680 inches or more.

After formation of the balls, the balls are optionally subjected to gamma radiation. This has been found to cross-link the cover to improve scuff and cut resistance. Furthermore, the gamma radiation has also been found to increase the cross-link density of the core and results in a harder and higher compression core and ball. And so, the Shore C hardness of the core typically increases after gamma treatment.

After molding and/or radiation treatment, the golf balls produced may undergo various further processing steps such as buffing, painting and marking as disclosed in U.S. Pat. No. 4,911,451.

The resulting golf ball produced from the hard inner layer and the relatively softer, low flexural modulus outer layer provides for an improved multi-layer golf ball having a unique dual core configuration which provides for desirable coefficient of restitution and durability properties while at the same time offering the feel and spin characteristics associated with soft balata and balata-like covers of the prior art.

As mentioned above, resiliency and compression are amongst the principal properties involved in a golf ball's performance. In the past, PGA compression related to a scale of 0 to 200 given to a golf ball. The lower the PGA compression value, the softer the feel of the ball upon striking. In practice, tournament quality balls have compression ratings around 70 to 110, preferably around 80 to 100.

In determining PGA compression using the 0 to 200 scale, a standard force is applied to the external surface of the ball. A ball which exhibits no deflection (0.0 inches in deflection) is rated 200 and a ball which deflects 2/10th of an inch (0.2 inches) is rated 0. Every change of 0.001 of an inch in deflection represents a 1 point drop in compression. Consequently, a ball which deflects 0.1 inches (100×0.001 inches) has a PGA compression value of 100 (i.e., 200 to 100) and a ball which deflects 0.110 inches (110×0.001 inches) has a PGA compression of 90 (i.e., 200 to 110).

In order to assist in the determination of compression, several devices have been employed by the industry. For example, PGA compression in determined by an apparatus fashioned in the form of a small press with an upper and lower anvil. The upper anvil is at rest against a die spring, and the lower anvil is movable through 0.300 inches by means of a crank mechanism. In its open position the gap between the anvils is 1.780 inches allowing a clearance of 0.100 inches for insertion of the ball. As the lower anvil is raised by the crank, it compresses the ball against the upper anvil, such compression occurring during the last 0.200 inches of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inches.

An example to determine PGA compression can be shown by utilizing a golf ball compression tester produced by Atti Engineering Corporation of Newark, N.J., now manufactured by OK Automation of Sinking Spring, Pa. The value obtained by this tester relates to an arbitrary value expressed by a number which may range from 0 to 100, although a value of 200 can be measured as indicated by two revolutions of the dial indicator on the apparatus. The value obtained defines the deflection that a golf ball undergoes when subjected to compressive loading. The Atti test apparatus consists of a lower movable platform and an upper movable spring-loaded anvil. The dial indicator is mounted such that it measures the upward movement of the spring loaded anvil. The golf ball to be tested is placed in the lower platform, which is then raised a fixed distance. The upper portion of the golf ball comes in contact with and exerts a pressure on the springloaded anvil. Depending upon the distance of the golf ball to be compressed, the upper anvil is forced upward against the spring.

Alternative devices have also been employed to determine compression. For example, Applicants also utilize a modified Riehle Compression Machine originally produced by Riehle Bros. Testing Machine Company, Phil., Pa. to evaluate compression of the various components (i.e., cores, mantle cover balls, finished balls, etc.) of the golf balls. The Riehle compression device determines deformation in thousandths of an inch under a load designed to emulate the force applied by the Atti or PGA compression tester. Using such a device, a Riehle compression of 61 corresponds to a deflection under load of 0.061 inches.

Additionally, an approximate relationship between Riehle compression and PGA compression exists for balls of the same size. It has been determined by Applicants that Riehle compression corresponds to PGA compression by the general formula PGA compression=160-Riehle compression. Consequently, 80 Riehle compression corresponds to 80 PGA compression, 70 Riehle corresponds to 90 PGA compression, and 60 PGA compression corresponds to 100 PGA compression. For reporting purposes, Applicants' compression values are usually measured as Riehle compression and converted to PGA compression.

Furthermore, additional compression devices may also be utilized to monitor golf ball compression so long as the correlation to PGA compression is known. These devices have been designed, such as a Whitney Tester, Instron, etc., to correlate or correspond to PGA compression through a set relationship or formula.

As used herein, "Shore D hardness" or "Shore C hardness" of a core or cover component is measured generally in accordance with ASTM D-2240, except the measurements are made on the curved surface of the molded component, rather than on a plaque. Furthermore, the Shore C-D hardness of the cover is measured while the cover remains over the core. When a hardness measurement is made on a dimpled cover, Shore C-D hardness is measured at a land area of the dimpled cover.

Having generally described the invention, the following examples are included for purposes of illustration so that the invention may be more readily understood and are in no way intended to limit the scope of the invention unless otherwise specifically indicated.

EXAMPLE

Dual Core Golf Balls with Pressurized Foamed Centers

A trial was performed in which pressurized center core components were prepared as described herein and used in forming dual core assemblies. Physical properties of the dual core assemblies were then measured. Comparative testing was performed between two sets of center cores, each formed with different amounts of blowing agent. A third set of single cores were also tested and used as controls.

Center cores of 11/32 inches (i.e., 0.34375 inches) were formed from the following composition:

| | Parts by Weight | Sp. Gr. |
|---|---|---|
| Natsyn ™ 2200 | 100 | .91 |
| Zinc oxide | 5 | 5.57 |
| Zinc stearate | 1 | 1.09 |
| Celogen ® TSH[1] | 15 | 1.42 |
| Green M.B. | 0.1 | — |
| Peroxide | 3 | 1.4 |
| | 124.1 | |
| Specific gravity of composition | | 0.997 |

[1]Celogen ® TSH is a foaming agent and is p-toluene sulfonyl hydrazide.

Various slugs were formed using this composition. It was determined that slugs of at least 0.12 g of the composition were necessary to sufficiently fill the center cavity of the double core with foamed rubber after molding.

Several more double cores were molded using 0.15 gram slugs or "pills" of the above green rubber composition molded inside the 11/32" diameter inner core surrounded with a conventional polybutadiene outer core stock. After molding, the pressurized double cores had the following average physical properties.

| Compression | | Size | | Weight | |
|---|---|---|---|---|---|
| Reihle | PGA | Pole | Equator | grams | C.O.R. |
| 97 | 63 | 1.570" | 1.559 | 37.2 | .795 |

The molded pressurized cores were cut in half to determine the extent of foaming. When cut open using a sharp Guillotine cutter, the foamed rubber core rapidly expanded to about double in size forming a very soft cross-linked cellular sphere.

After about 24 hours, the cellular rubber cores that were cut open deflated to their original size indicating a loss in nitrogen gas.

Another set of dual cores were molded using the following outer core stock.

| | Parts by Weight |
|---|---|
| Polybutadiene BCP-820 | 40 |
| Polybutadiene Neo-Cis ®60 | 30 |
| Polybutadiene Neo-Cis ®40 | 30 |
| Zinc stearate | 16 |
| Zinc diacrylate | 28 |
| Zinc oxide | 20 |
| Red M.B. | 0.70 |
| Triginox 42-40B | 1.25 |
| | 165.95 |

The specific gravity of this composition was 1.161.

The cores were molded using 0.25 g, 0.30 g, and 0.35 g slugs or "pills" of the green rubber composition. The dual cores were molded using steam at 310° F. for 12 minutes and 10 minutes cooling water.

The pressurized cores had the following properties:

| Pill | Compression | | Size | | Weight | |
|---|---|---|---|---|---|---|
| Wgt. | Reihle | PGA | Pole | Equator | grams | C.O.R. |
| 0.25 g | 97 | 63 | 1.565" | 1.559 | 36.9 | .797 |
| 0.30 g | 98 | 62 | 1.569" | 1.559 | 37.1 | .795 |
| 0.35 g | 99 | 61 | 1.568" | 1.562 | 36.9 | .786 |

As the C.O.R. dropped off with increasing pill weight, the 0.25 gram pill had the optimum amount of pressure.

Pressurized double cores having 0.25 grams of green colored nucleus stock were injection molded using an ionomer cover with a Shore D 60 hardness into finished dimpled golf balls with the following average physical properties.

| Compression | | Size | | Weight | |
|---|---|---|---|---|---|
| Reihle | PGA | Pole | Equator | grams | C.O.R. |
| 81 | 79 | 1.687 | 1.688 | 45.4 | .813 |

These balls have a soft compression with a very high C.O.R.

The invention has been described with reference to the preferred embodiments. Obviously, modifications and alterations will occur to others upon a reading and understanding the preceding detailed description. It is intended that the invention be construed as including all such modifications and alterations in so far as they come within the scope of the appended claims or the equivalents thereof.

What is claimed is:

1. A golf ball comprising:

a dual core assembly including a pressurized foamed center core and at least one core layer disposed about said center core, said center core comprising a pressurized gas wherein said gas contained in said center is at a pressure greater than atmospheric pressure, and said core layer comprising polybutadiene; and a cover layer assembly disposed about said dual core assembly.

2. The golf ball of claim 1, wherein said pressurized foamed center core exhibits a closed-cell structure.

3. The golf ball of claim 1, wherein said pressurized foamed center core exhibits an open-cell structure.

4. The golf ball of claim 1, wherein said center core further comprises a decomposed chemical blowing agent.

5. The golf ball of claim 4, wherein said decomposed chemical blowing agent is selected from the group consisting of p-toluene sulfonyl hydrazide, sodium bicarbonate, 2,2'-azobisisobutyronitrile, azodicarbonamide, 4,4'-oxy-bis (benzenesulfonyl hydrazide), dinitrosopentamethylenetetramine, and combinations thereof.

6. The golf ball of claim 5, wherein said decomposed chemical blowing agent comprises p-toluene sulfonyl hydrazide.

7. The golf ball of claim 1, wherein said center core further comprises a cross-linking agent.

8. The golf ball of claim 1, wherein said gas contained in said center core includes nitrogen.

9. The golf ball of claim 1, wherein said center core has a center core outer region and said core layer has a core layer inner region immediately adjacent to said center core outer region, and said core layer inner region is bonded to said center core outer region.

10. The golf ball of claim 9, wherein said bonding between said core layer inner region and said center core outer region is achieved at least in part by chemical cross-linking.

11. The golf ball of claim 1, wherein said cover layer assembly includes at least one inner cover layer and an outer cover layer.

12. The golf ball of claim 1, wherein the specific gravity of said center core is less than about 1.1.

13. The golf ball of claim 1, wherein the pressurized foamed center has a diameter of about 0.15 inches to about 1.0 inches.

14. The golf ball of claim 1, wherein the core layer has a thickness of about 0.125 inches to about 0.725 inches.

15. The golf ball of claim 1, wherein said polymeric material comprises polyisoprene or a halobutyl rubber.

16. The golf ball of claim 1 further comprising at least one barrier layer, wherein said barrier layer is formed in between any one of the core and cover layers.

17. A golf ball comprising:

a dual core assembly including a center core and at least one core layer disposed about said center core, said center core comprising cross-linked polymeric material and a plurality of interior cells containing a pressurized gas wherein said gas in said center core is at a pressure greater than atmospheric pressure; and a cover layer assembly disposed about said dual core assembly.

18. The golf ball of claim 17, wherein said center core is produced by foaming and exhibits a closed-cell structure.

19. The golf ball of claim 17, wherein said plurality of interior cells are produced by a chemical blowing agent and wherein the plurality of interior cells exhibit an open-cell structure.

20. The golf ball of claim 17, wherein said outer core layer comprises polybutadiene, a metal carboxylate cross-linking agent, a free radical initiator and a heavy weight filler having a specific gravity of 2.7 or more.

21. The golf ball of claim 17, wherein the plurality of interior cells are uniformly distributed throughout the center core.

* * * * *